US011548679B2

(12) United States Patent
Bressan et al.

(10) Patent No.: US 11,548,679 B2
(45) Date of Patent: Jan. 10, 2023

(54) CHILDPROOF CONTAINER AND PROCESS OF MAKING THE SAME

(71) Applicant: I.G.B. S.R.L., Milan (IT)

(72) Inventors: Michel Bressan, Induno Olona (IT); Alessio Bressan, Varese (IT); Alberto Gandolla, Induno Olona (IT)

(73) Assignee: I.G.B. S.R.L., Milan (IT)

( * ) Notice: Subject to any disclaimer, the term of this patent is extended or adjusted under 35 U.S.C. 154(b) by 293 days.

(21) Appl. No.: 16/852,436

(22) Filed: Apr. 18, 2020

(65) Prior Publication Data

US 2020/0331652 A1 Oct. 22, 2020

(30) Foreign Application Priority Data

Apr. 19, 2019 (IT) ..... 102019000006202

(51) Int. Cl.
*B65D 5/02* (2006.01)
*B65D 5/66* (2006.01)
(Continued)

(52) U.S. Cl.
CPC ..... *B65D 5/0254* (2013.01); *B65D 5/6685* (2013.01); *B65D 50/00* (2013.01); *B65D 85/1045* (2013.01); *B65D 2215/00* (2013.01)

(58) Field of Classification Search
CPC ..... B65D 5/0254; B65D 50/00; B65D 85/1045; B65D 2215/00; B65D 85/10484; B65D 85/1048; B65D 5/6685
(Continued)

(56) References Cited

U.S. PATENT DOCUMENTS 2,361,659 A * 10/1944 Smith ..... B65D 5/543 229/160.1
2,511,523 A * 6/1950 Abrams ..... B65D 5/6664 229/149
(Continued)

FOREIGN PATENT DOCUMENTS

JP 11245940 A2 9/1999
JP 2014141276 A2 8/2014
WO 2016198979 A1 12/2016

OTHER PUBLICATIONS

Early Search Report for Italian Patent Application No. 201900006202, The Hague, dated Feb. 18, 2020.

*Primary Examiner* — Andrew D Perreault

(57) ABSTRACT

The present invention relates to a childproof container (1) comprising a store (2) and a closure system (7) and defining a compartment (8). The container comprises a safety device (11) with a first coupling portion (12) and a second coupling portion (13) configured to engage each other stably in an internal volume of the container (1) in a closing condition of the closure system (7) to define a locking condition wherein they prevent the closure system (7) from switching from the closing to the opening condition. The closure system (7) comprises an unlocking portion (18) configured to define a through access (19) that allows, in the locking condition of the safety device (11), the insertion of an opening device (20) into the internal volume of the container (1) that allows the disengagement between the first and second coupling portions (12, 13). The container comprises a guide body (24) carried by at least one between the second coupling portion (13) and the closure system (7). The guide body (24), in the closing condition of the closure system (7), is placed in the internal volume of the container (1) and is configured to guide the opening device (20) towards the safety device (11).

18 Claims, 12 Drawing Sheets

(51) Int. Cl.
*B65D 85/10* (2006.01)
*B65D 50/00* (2006.01)

(58) Field of Classification Search
USPC ..... 206/247, 273; 229/148, 160.1
See application file for complete search history.

(56) References Cited

U.S. PATENT DOCUMENTS

| | | | | | |
|---|---|---|---|---|---|
| 2,711,282 | A | | 6/1955 | D'Esposito | |
| 3,235,167 | A | * | 2/1966 | Svensson | B65D 5/5435 229/149 |
| 3,357,631 | A | * | 12/1967 | Aid | B65D 5/54 229/149 |
| 3,910,487 | A | * | 10/1975 | Jaeschke | B65D 5/5435 229/149 |
| 3,966,113 | A | * | 6/1976 | Tipton | B65D 5/18 229/84 |
| 4,535,929 | A | | 8/1985 | Sherman, II et al. | |
| 4,948,038 | A | * | 8/1990 | Moeller | B65D 5/6685 229/149 |
| 5,511,722 | A | * | 4/1996 | Dixon | B65D 85/1045 229/149 |
| 5,749,462 | A | * | 5/1998 | Houghton | B65D 85/1045 206/268 |
| 6,334,532 | B1 | * | 1/2002 | Tambo | B65D 85/10564 229/148 |
| 6,484,931 | B1 | * | 11/2002 | Hofte | B65D 5/6608 229/149 |
| 6,719,131 | B1 | * | 4/2004 | Focke | B65D 85/10564 229/148 |
| 2001/0030135 | A1 | | 10/2001 | Fath et al. | |
| 2018/0162587 | A1 | * | 6/2018 | Bressan | B65D 5/6608 |

* cited by examiner

CHILDPROOF CONTAINER AND PROCESS OF MAKING THE SAME

FIELD OF THE INVENTION

The present invention relates to a childproof container and a process of making the same. The container may be used in fields that require the packaging of products and where it is required, for safety reasons, the inhibition of opening the container by children. For example, the container may be used in the packaging fields for products containing tobacco, such as cigarettes, or similar products.

BACKGROUND

As is well known, childproof containers are available on the market which are designed to be difficult to open by a majority of children under 5 years of age; for example, these types of containers are used in the pharmaceutical field to prevent children from ingesting medications potentially harmful to them and thus prevent accidental poisoning.

A known type of childproof container is described in patent application No. WO 2016/198978 A1. Such container comprises a store for the storage of products: the store has a passage opening at which a closure system is hinged. Inside the store there is a hook suitable to cooperate with a respective hook carried by the closure system; the hooks of the store and of the closure system are configured to stably engage each other during a closing condition of the closure system so as to prevent the opening of the container. Moreover, the container has one or more slots, defined on a top wall of the closure system, which allow the insertion of a tab inside the container to allow the release of said hooks and thus the opening of the container.

A different type of container is described in US patent application No. US 2001/030135 A1. Such application describes a tamper evident cigarette package comprising a store for containing cigarettes closable by means of a closure system; during the manufacturing step, the closure system is joined in one piece to the store by means of weakened portions configured to break following a first opening of the package to give evident of a first opening of the package.

OBJECT OF THE INVENTION

The object of the present invention is therefore to substantially solve at least one of the disadvantages and/or limitations referred to in the state of the art.

A first objective of the present invention is to provide a childproof container with a simple and compact structure, which can be realized quickly and economically, for example by means of standard apparatus; in particular, it is aim of the present invention to make a container which does not require the modification of the common plants used today for the realization of standard type containers and which also do not require the modification of the existing packaging plants for the filling of the container itself. It is then the purpose of the present invention to provide a container that can be effectively childproof but at the same time can be easily opened by an adult; in particular, it is the purpose of the present invention to provide a container flexible in use that can be opened by an adult with different and common opening devices. The purpose of the present invention is to provide a container that is structurally compact, resistant and at the same time light. It is also the purpose of the present invention to provide a container with a stable structure able to guarantee its integrity following multiple openings and closures of the same.

These purposes and others, which will appear more from the following description, are substantially achieved by a container and a process of making the same according to one or more of the enclosed claims and/or the following aspects, taken alone or in any combination between them or in combination with any one of the enclosed claims and/or in combination with any one of the further aspects or features described below.

SUMMARY

In an aspect a childproof container is provided comprising:

- a store made of sheet material comprising at least one front wall, one rear wall opposite the front wall and one first and second side walls also opposite each other, said front wall, rear wall and first and second side walls defining a passage opening delimited by a free edge,
- at least one closure system also made of sheet material engaged at the rear wall of the store at the free edge and movable, optionally by rotation, with respect to the free edge of the store at least between:
  - a closing condition in which the closure system interdicts the communication between the passage opening of the store and the external environment,
  - an opening condition in which the closure system allows the communication between the passage opening and the external environment,
- wherein the closure system and the store, in the closing condition, cooperate to define an internal volume of the container,
- at least a safety device made of sheet material exhibiting:
  - at least a first coupling portion carried by the closure system,
  - at least one second coupling portion arranged, in the closing condition of the closure system, in the internal volume of the container, said second coupling portion being at least in part directly facing the front wall of the store and being configured to cooperate with said first coupling portion,
- the first and second coupling portions being configured to engage each other stably in the internal volume of the container in the closing condition of the closure system to define a locking condition in which said first and second coupling portions prevent the closure system from switching from the closing to the opening condition.

In a further aspect according to the preceding aspect, the closure system comprises an unlocking portion configured to define at least one through access configured to allow, at least in the locking condition of the safety device, the at least partial insertion of an opening device into the internal volume of the container configured to allow the disengagement between the first and second coupling portions and consequently the passage of the closure system from the closing condition to the opening condition.

In a further aspect according to any one of the preceding aspects, the closure system comprises a top panel from which at least one front panel, a first and a second side panel emerge, the top panel, the front panel, the first side panel and the second side panel defining a compartment delimited by a respective free edge.

In a further aspect according to any one of the preceding aspects, the front panel of the closure system, in the closing condition, is positioned at the front wall of the store.

In a further aspect according to any one of the preceding aspects, the first coupling portion is carried by the front panel of the closure system.

In a further aspect according to any one of the preceding aspects, the unlocking portion is defined on the front panel of the closure system.

In a further aspect according to any one of the preceding aspects, the unlocking portion is defined in interposition between the first coupling portion of the safety device and the top panel of the closure system.

In a further aspect according to any one of the preceding aspects, the container comprises at least one guide body carried by at least one between the second coupling portion and the closure system, said guide body, in the closing condition of the closure system, being placed in the internal volume of the container and facing the unlocking portion, wherein the guide body is configured to guide the opening device towards the safety device.

In a further aspect according to any one of the preceding aspects, the through access is perimetrically delimited by a closed path profile.

In a further aspect according to any one of the preceding aspects, the through access totally develops on the front panel of the closure system.

In a further aspect according to any one of the preceding aspects, the through access is spaced from the free edge of the closure system and from the top panel.

In a further aspect according to any one of the preceding aspects of the guide body, the first coupling portion and the second coupling portion develops entirely in the internal volume of the container in the closing condition of the closure system.

In a further aspect according to any one of the preceding aspects, the guide body extends, in the closing condition of the closure system, into the compartment of the closure system.

In a further aspect according to any one of the preceding aspects the guide body emerges beyond the free edge of the store.

In a further aspect according to any one of the preceding aspects the guide body is directly carried by the second coupling portion.

In a further aspect according to any one of the preceding aspects the guide body is joined in one piece with the second coupling portion.

In a further aspect according to any one of the preceding aspects the second coupling portion is arranged inside the store at the free edge of the store, the guide body extends in extension of the second coupling portion along a direction exiting the store.

In a further aspect according to any one of the preceding aspects the store comprises a bottom wall connected to the front, rear and side walls (first and second side walls) of the store on the opposite side to the opening of the latter, wherein the guide body is arranged at a height greater than a height of the free edge of the store, these heights of the guide body and of the free edge of the store being respectively defined as the distance of the guide body and the free edge from the bottom wall respectively.

In a further aspect according to any one of the preceding aspects, the second coupling portion comprises a body made of sheet material.

In a further aspect according to any one of the preceding aspects the guide body comprises a body made of sheet material.

In a further aspect according to any one of the preceding aspects the second coupling portion and the guide body define a single sheet material panel placed inside the store directly facing the front wall of the store.

In a further aspect according to any one of the preceding aspects, the container comprises a sheet material panel, optionally engaged to the front wall of the store, comprising the second coupling portion and the guide body.

In a further aspect according to any one of the preceding aspects, the container comprises at least one pushing device placed at least partially inside the store at the second coupling portion, the pushing device being configured to push at least one of these first and second coupling portions to ensure the engagement of the latter and thus keep the safety device in the locking condition.

In a further aspect according to any one of the preceding aspects, the pushing device acts in push only on the first coupling portion.

In a further aspect according to any one of the preceding aspects, the pushing device is configured to contact the first coupling portion during the passage of the closure system from the opening to the closing condition and push said first coupling portion against said second coupling portion.

In a further aspect according to any one of the preceding aspects, the pushing device is placed in the store.

In a further aspect according to any one of the preceding aspects, the pushing device is carried directly by the front wall of the store.

In a further aspect according to any one of the preceding aspects the pushing device is joined in a single piece to the front wall of the store.

In a further aspect according to any one of the preceding aspects, the pushing device emerges transversely from the front wall of the store.

In a further aspect according to any one of the preceding aspects, the pushing device is elastically movable between:

- a thrust condition in which it operates in thrust on the safety device in the closing condition of the closure system in order to maintain the first coupling portion in engagement to the second coupling portion, and
- a rest condition.

In a further aspect according to any one of the preceding aspect, the pushing device defines the rest condition in the opening condition of the closure system, where the movement of the pushing device between the rest condition and the thrust condition is triggered by the first coupling portion during the passage of the closure system from the opening condition to the closing condition and defines a snap engagement between the first coupling portion and the second coupling portion.

In a further aspect according to any one of the preceding aspects, the pushing device comprises a tab made of sheet material joined in a single piece to the front wall of the store.

In a further aspect according to any one of the preceding aspects, the sheet material tab of the pushing device is joined in one piece to the free edge of the store and folded around this free edge inside the store.

In a further aspect according to any one of the preceding aspects, the pushing device consists exclusively of a tab made of paper sheet material.

In a further aspect according to any one of the preceding aspects the store is made of paper sheet material.

In a further aspect according to any one of the preceding aspects the closure system is made of paper sheet material.

In a further aspect according to any one of the preceding aspects the safety device is made of paper sheet material.

In a further aspect according to any one of the preceding aspects, the closure system comprises a rear panel opposite the front panel.

In a further aspect according to any one of the preceding aspects, the rear panel is directly constrained to the free edge of the store. In a further aspect according to any one of the preceding aspects, exclusively the rear panel of the closure system is directly constrained to the free edge of the store.

In a further aspect according to any one of the preceding aspects, the second coupling portion comprises at least one hook delimiting an undercut and defining a passage seat.

In a further aspect according to any one of the preceding aspects, the pushing device is arranged at least partially inside the passage seat of the hook of the second coupling portion.

In a further aspect according to any one of the preceding aspects, the tab of the pushing device at least partially passes through the passage seat of the hook of the second coupling portion.

In a further aspect according to any one of the preceding aspects, the hook of the second coupling portion has a concavity facing, in the closing condition, the opposite side of the closure system.

In a further aspect according to any one of the preceding aspects, the first coupling portion comprises at least one respective hook delimiting a respective undercut and defining a respective seat, the hook of the first coupling portion, in locking condition, is engaged to the hook of the second coupling portion.

In a further aspect according to any one of the preceding aspects the first coupling portion is insertable into the seat of the hook of the second coupling portion.

In a further aspect according to any one of the preceding aspects, the first coupling portion, in the locking condition, is arranged inside the passage seat of the hook of the second coupling portion.

In a further aspect according to any one of the preceding aspects, the pushing device, in the closing condition of the closure system, is configured to act in push on the first coupling portion to keep the hook of the first coupling portion engaged to the hook of the second coupling portion.

In a further aspect according to any one of the preceding aspects, the pushing device, in the closing condition of the closure system, is configured to keep the hooks of the first and second coupling portions engaged to each other and consequently maintain the locking condition of the safety device.

In a further aspect according to any one of the preceding aspects, the second coupling portion comprises a main body to which the hook of the second coupling portion is engaged.

In a further aspect according to any one of the preceding aspects, the hook of the second coupling portion has a concavity facing the main body. In a further aspect according to any one of the preceding aspects, the passage seat is defined between the main body and the hook of the second coupling portion.

In a further aspect according to any one of the preceding aspects, the hook of the second coupling portion comprises a first and a second connection ends and a central body interposed between the first and second connection ends, the first and second connection ends constraining (connecting) the central body of the hook to the main body.

In a further aspect according to any one of the preceding aspects, the pushing device is configured to act on the first coupling portion (optionally on the hook of said first coupling portion) to move it away from the front wall and allow its engagement (optionally snap) to the second coupling portion (optionally on the hook of said second coupling portion). In a further aspect according to any one of the preceding aspects, the container comprises a removable portion that may be positioned at the unlocking portion and configured to occlude at least partially the through access. In a further aspect according to any one of the preceding aspects, the removable portion is configured to define an intact condition wherein it at least partially obstructs the through access. In an additional aspect according to any one of the preceding aspects the removable portion is configured to define a violated condition from which it is at least partially removed from the unlocking portion and allows the access to through access. In a further aspect according to any one of the preceding aspects the removable portion being configured to give evidence of a tampering attempt of the container. In a further aspect according to any one of the preceding aspects, the removable portion is configured to switch non-reversible from the intact condition to the violated condition at the time of a first opening or first attempt to open the container such that the switch of the removable portion to the violated condition gives evidence of tampering with the container.

In a further aspect according to any one of the preceding aspects, the removable portion comprises a removable panel, for example a tearable panel, or a plastically deformable membrane, for example a fractureable membrane.

In a further aspect according to any one of the preceding aspects, the container comprises at least an opening device configured to be inserted, at least in the locking condition of the safety device, into the internal volume of the container by means of the said through access to allow the disengagement between the first and second coupling portions and consequently the passage of the closure system from the closing condition to the opening condition.

In a further aspect according to any one of the preceding aspects, the opening device is insertable in interposition between the first and the second coupling portions in order to allow the disengagement and the passage of the closure system from the closing condition to the opening condition.

In a further aspect according to any one of the preceding aspects the tab is configured to be arranged, with respect to the front wall of the store:

in the rest condition, in a first angular position having a prefixed angular width, in the thrust condition, in a second angular position angularly offset from the first angular position and having a respective angular width, the angular width of the second angular position being smaller than the angular width of the first angular position.

In a further aspect according to any one of the preceding aspects, the tab is elastically and reversibly movable between the rest condition and the thrust condition.

In a further aspect according to any one of the preceding aspects, the first coupling portion is elastically deformable with respect to the front panel of the closure system allowing the first coupling portion to be inserted into the store and the engagement with the second coupling portion.

In a further aspect according to any one of the preceding aspects, the first coupling portion is elastically deformable.

In a further aspect a method of opening a childproof container is provided, said method comprising the following steps:

providing a container according to any one of the preceding aspects, wherein the closure system is in a locking condition, optionally, define the through access, insert at least partially an opening device through the through access, contact the guide body by means of the opening device, guide, by means of the guide body, the opening device towards the safety device, disengage, by means of the opening device, the first and second coupling portions.

In a further aspect according to any one of the preceding aspects, the method comprises the phase of interposing the opening device between the first coupling portion and a passage seat of the second coupling portion, said phase of interposing the opening device being subsequent to the phase of contacting, through the opening device, the guide body and being prior to the phase of disengaging, through the opening device, the first and second coupling portions. In a further aspect according to any one of the preceding aspects, providing a container comprises providing a pushing device developing in the store at the second coupling portion transversely to the front wall and operating, for example elastically, in thrust on the safety device in the closing condition of the closure system to keep the first coupling portion in engagement to the second coupling portion and consequently to keep the locking condition of the safety device, wherein the opening device is to be interposed between the first coupling portion and a passage of the second coupling portion comprising overcoming a thrust, for example an elastic thrust, exerted by the pushing device on the first coupling portion in such a way as to disengage an undercut of the first coupling portion from an undercut of the second coupling portion.

In a further aspect according to any one of the preceding aspects, the method comprises the phase of moving, optionally by rotation, the closure system relative to the store in such a way as to determine the passage of the closure system from the closed condition to the opening condition.

In a further aspect according to any one of the preceding aspects, handling, optionally by rotation, the closure system with respect to the store comprises moving the opening device integrally with the closure system, optionally by rotation. In a further aspect according to any one of the preceding aspects, providing a container comprises providing a container comprising a tamper evident portion configured to operate between an intact condition in which it prevents access to through access and a violated condition in which it allows access to through access, the method comprising a step of defining a non-reversible passage of the tamper evident portion from the intact to the violated condition in such a way as to allow access to the through access, said step being prior to the step of at least partial insertion of an opening device through the through access.

In a further aspect according to any one of the preceding step, defining a non-reversible passage of the tamper evident portion from the intact condition to the violated condition in such a way as to allow access to the through access comprises removing or tearing a panel from the release portion and/or plastically deforming a membrane, for example by fracturing it.

In one aspect a blank in sheet material is provided, optionally configured to form a container according to any one of the preceding aspects, comprising:

a first sheet comprising at least one first and one second portion interconnected by a central connecting portion, the first portion, second portion and the central connecting portion being aligned along one direction of connection, the first and the second portion comprising at least two opposite longitudinal edges and two opposite extremal edges, the central connecting portion being joined to the first and the second portion along opposite longitudinal edges or along opposite extremal edges, the first sheet also comprises at least one side connecting portion joined to the first portion along an opposite longitudinal edge to the longitudinal edge of the first portion to which the central connecting portion is joined or a first and a second side connecting portion joined to the first portion along opposite longitudinal edges, the first sheet also comprises a tilting portion joined to the second portion along a longitudinal edge opposite with respect to the longitudinal edge of the second portion to which is joined the central connecting portion or a third and a fourth side connecting portion joined to the second portion along respective opposite longitudinal edges, the first sheet being configured to form a store, a second sheet connected to an extremal edge of the first portion of the first sheet, the second sheet comprising a first, a second and a third portion joined together in one piece, the first portion of the second sheet being interposed between the first portion of the first sheet and the second portion of the second sheet, the second portion of the second sheet being interposed between the first portion of the second sheet and the third portion of the second sheet, the third portion of the second sheet being joined in one piece to the second portion of the second sheet, optionally the third portion of the second sheet having at least one through access or a portion configured to define a through access, the first, second and third portion of the second sheet being configured to form a back panel, a top panel and a front panel of a closure system respectively, a third sheet, optionally separated from the first sheet and the second sheet or in one piece with the first sheet, comprising a first portion having at least two opposite longitudinal edges and two opposite extremal edges, optionally the third sheet being joined to the first sheet along a longitudinal edge, the third sheet also comprising at least one side connecting portion joined to the first portion of the third sheet along a longitudinal edge opposite to the longitudinal edge to which the first sheet is joined or a first and a second side connecting portion joined to the first portion of the third sheet along respective opposite longitudinal edges, the third sheet being configured to form the second coupling portion of a security device and the guide body, optionally the third sheet comprising a window or a notch configured to define, under operating conditions of the container, a window, a fourth sheet comprising at least one portion joined to the third portion of the second sheet and configured to form a first coupling portion of the safety device.

In a further aspect according to any one of the preceding aspects, the first sheet also comprises a third portion joined in one piece to the extremal edge of the first portion opposite the extremal edge to which the first portion of the second sheet is joined and a fourth portion joined in one piece to an extremal edge of the second sheet arranged by the same part of the blank with respect to the extremal edge of the first portion of the first sheet to which the third portion of the first sheet is joined, the third portion and the fourth portion of the first sheet being configured to form a rear wall of the container.

In a further aspect according to any one of the preceding aspects, the blank sheet comprises a fifth sheet joined in one piece with the first sheet and comprising at least one portion connected to one extremal edge of the tilting portion of the first sheet or to one extremal edge of the second portion of the first sheet opposite the extremal edge to which the central connecting portion is connected, the fifth sheet being configured to form the pushing device.

In a further aspect according to any one of the preceding aspects, the blank sheet comprises a sixth sheet at least partially connected to an extremal edge of the second sheet and comprising a first portion, a second portion and a third portion, the second portion being interposed between the first portion and the third portion, optionally the first portion being a weakened portion and being connected to said extremal edge of the first sheet and to the second portion along respective weakening lines, the sixth sheet being configured to form a tamper evident portion, optionally the first portion being configured to form a tearable panel.

In a further aspect according to any one of the preceding aspects, the blank comprises a seventh sheet separated from said first, second, third, fourth, fifth and sixth sheets or in one piece with at least one of said first, second, third, fourth, fifth or sixth sheets, the seventh sheet comprising at least a portion configured to form the opening device.

In a further aspect a procedure for the construction of a childproof container is provided, optionally according to any one of the preceding aspects, comprising the following steps:

- prepare a blank according to any one of the preceding aspects,
- fold the first sheet along said longitudinal edges or along said extremal edges,
- form a store, the phase of formation of the store comprising:
  - join lateral connecting portions to each other, optionally by gluing, or
  - join the lateral connection portion of the third sheet to the central connection portion of the first sheet, optionally by gluing,
- fold said first, second and third portion of the second sheet so as to respectively form a back panel, a top panel and a front panel of a closure system,
- forming the second coupling portion of the safety device and the guide body, the formation phase of the second coupling portion of the safety device and the guide body comprising placing the first portion of the third sheet in front of the first portion of the first sheet,
- Prepare the fourth sheet to form the first coupling portion of the safety device.

In a further aspect according to any one of the preceding aspects, the phase of forming the second coupling portion of the safety device and the guide body comprises folding the side connecting portions of the third sheet with respect to the first portion of the third sheet, the phase of folding the side connecting portions of the third sheet with respect to the first portion of the third sheet being prior to the phase of arranging the first portion of the third sheet frontally with respect to the first portion of the first sheet, the phase of arranging the first portion of the third sheet frontally with respect to the first portion of the first sheet comprising a phase of:

- join the first lateral connecting portion of the third sheet to the first lateral connecting portion of the first sheet, and
- a phase of joining the second lateral connection portion of the third sheet to the second lateral connection portion of the first sheet, optionally at least one of these joining stages being made by gluing.

In a further aspect according to any one of the preceding aspects, the phase of arranging the first portion of the third sheet frontally with respect to the first portion of the first sheet comprises a phase of arranging the first lateral connecting portion of the third sheet and the second lateral connecting portion of the third sheet at a space inside the first sheet defined between the first and the second lateral connecting portion of the first sheet, the phases of joining the first lateral connecting portion of the third sheet to the first lateral connecting portion of the first sheet and joining the second lateral connecting portion of the third sheet to the second lateral connecting portion of the first sheet being subsequent to the phase of arrangement of the first lateral connecting portion of the third sheet and the second lateral connecting portion of the third sheet at an internal space of the first sheet defined between the first and second lateral connecting portion of the first sheet.

In a further aspect according to any one of the preceding aspects, joining the first lateral connecting portion of the third sheet to the first lateral connecting portion of the first sheet comprises gluing an outer surface of the first lateral connecting portion of the third sheet to an inner surface of the first lateral connecting portion of the first sheet.

In a further aspect according to any one of the preceding aspects, joining the second lateral connecting portion of the third sheet to the second lateral connecting portion of the first sheet comprises gluing an outer surface of the second lateral connecting portion of the third sheet to an inner surface of the second lateral connecting portion of the first sheet. In a further aspect according to any one of the preceding aspects, the procedure comprises a step of making at least one through access or a portion configured to define a through access at the third portion of the second sheet, for example by die-cutting and/or punching the third portion of the second sheet, optionally punching the third portion of the second sheet being subsequent to die-cutting the third portion of the second sheet.

In a further aspect according to any one of the preceding aspects, forming the store comprises arranging the first and second portion of the first sheet facing each other in such a way that the central connecting portion forms a rear wall of the container.

In a further aspect according to any one of the preceding aspects, joining the lateral connecting portions between them comprises:

- join the third lateral connection portion of the first sheet and the first lateral connection portion of the first sheet to each other, optionally by gluing,
- join the fourth lateral connecting portion of the first sheet and the second lateral connecting portion of the first sheet to each other, optionally by gluing, these phases of joining the third and first portion of the lateral connecting portions of the first sheet and joining the fourth and second lateral connecting portions of the first sheet being subsequent to the phases of joining the first lateral connecting portion of the third sheet to the first lateral connecting portion of the first sheet and joining the second lateral connecting portion of the third sheet to the second lateral connecting portion of the first sheet.

In a further aspect according to any one of the preceding aspects, the formation phase of the store also comprises the phases of:

- fold the tilting portion of the first sheet relative to the second portion of the first sheet,
- join the tilting portion and the second portion of the first sheet together, optionally by gluing,
- following the joining phase of the lateral connecting portion of the third sheet to the central connecting portion of the first sheet, place the tilting portion on the first portion of the third sheet, optionally, join the tilting portion to the first portion of the third sheet, for example by gluing, optionally, join, for example by gluing, the third and fourth portions of the first sheet to form a rear wall of the store.

In a further aspect according to any one of the preceding aspects, the procedure also comprises the following steps:

prepare at least one product, place the product in the store or place the product on an area of the blank sheet intended to form an internal surface of the store, that surface being defined, for example, in correspondence with the first portion of the first sheet, so that the product is placed, after at least one folding and/or joining phase of at least two portions of those sheets intended to form the store, in the store.

In a further aspect according to any one of the preceding aspects, providing at least one product comprises providing at least one product of a type containing tobacco, such as a cigarette or cigar, or of a type suitable for use with, or as a substitute for, at least one product containing tobacco, or similar, optionally providing at least one product comprising providing several products.

In a further aspect according to any one of the preceding aspects, arranging the product on a surface of the blank surface intended to form an internal surface of the store comprises interposing the product between the first portion of the first sheet and the first portion of the third sheet, said phase of interposing the product being subsequent to the phase of arranging the first portion of the third sheet frontally with respect to the first portion of the first sheet.

In a further aspect according to any one of the preceding aspects, the procedure comprises a phase of formation of the pushing device, the phase of formation of the pushing device comprising:

fold the fifth sheet with respect to the extremal edge of the second portion of the first sheet, or fold the fifth sheet with respect to the extremal edge of the tilting portion.

In a further aspect according to any one of the preceding aspects, this phase of folding the fifth sheet with respect to the extremal edge of the tilting portion is prior to the phase of placing the tilting portion on the first portion of the third sheet, the phase of placing the tilting portion on the first portion of the third sheet comprising inserting the pushing device in the window of the third sheet.

In a further aspect according to any one of the preceding aspects, the procedure comprises a formation phase, on the first portion of the third sheet, of a window or a notch configured to define, in at least one operating condition of the container, a window, for example by die-cutting and/or punching the first portion of the third sheet, optionally the punching of the first portion of the third sheet being subsequent to the die-cutting of the first portion of the third sheet.

In a further aspect according to any one of the preceding aspects, the procedure comprises a tamper evident portion formation phase, said the tamper evident portion formation phase comprising:

fold the third portion of the sixth sheet with respect to the first and second portion of the sixth sheet, move the sixth sheet towards the second sheet, optionally the sixth sheet being moved integrally with the second portion of the first sheet in such a way as to contemporaneously bring the sixth sheet closer to the second sheet and the second portion of the first sheet closer to the first portion of the first sheet, join the third portion of the sixth sheet to the second portion of the second sheet, optionally by gluing.

In a further aspect according to any one of the preceding aspects, the procedure comprises a phase of making a weakened portion at the sixth sheet, the phase of making the weakened portion comprising weakening the sixth sheet along weakening lines, at least one weakening line, for example straight, being defined at the extremal connecting edge between the sixth sheet and the second portion of the first sheet and at least one more weakening line, for example at least partially curved, defining a profile of the first portion of the sixth sheet, the first portion of the sixth sheet forming the weakened portion.

In a further aspect according to any one of the preceding aspects, the phase of weakening the sixth sheet along weakening lines comprises cutting or punching the sixth sheet along weakening lines and the weakened portion comprising a tear-off panel.

In a further aspect according to any one of the preceding aspects, the procedure comprises a stage of providing the seventh sheet to form an opening device.

In a further aspect according to any one of the preceding aspects, the guide body is not of removable type. In an additional aspect according to any one of the preceding aspects, the guide body is at least partially parallel and/or at least partially transverse to the front wall of the store.

In a further aspect according to any one of the preceding aspects, the front wall, the rear wall and the first and second side panels define a compartment delimited by the free edge of the store and configured to house one or more products, such as cigarettes, optionally the compartment presenting a volume greater than the volume of the compartment.

In a further aspect according to any one of the preceding aspects, the first side wall and the second side wall of the store have a trapezoidal shape and the first side panel and the second side panel of the closure system have a respective trapezoidal shape.

In a further aspect according to any one of the preceding aspects, the free edge of the store and the free edge of the closure system are at least partially counter-shaped.

In a further aspect according to any one of the preceding aspects, the safety device does not have any removable portions at the first and the second coupling portion.

In a further aspect according to any one of the preceding aspects, the safety device is configured to allow the first and second coupling portion to reversibly switch, following the opening condition of the closure system, to the locking condition of the safety device.

In a further aspect according to any one of the preceding aspects, the container is a container to contain at least one product of the tobacco-containing type, such as a cigarette or cigar, optionally a multi-product type, or of the type suitable for use with, or to replace, at least one tobacco-containing product, or similar.

In a further aspect according to any one of the preceding aspects, the container is a pack of cigarettes.

In an aspect, the container shall be used according to any of the attached claims and/or any of the preceding aspects and/or carried out according to any one of the preceding aspects to contain at least one product of a type containing tobacco, such as a cigarette or a cigar, optionally a number of products, or of a type suitable for use with, or to replace, at least one product containing tobacco, or similar.

In one aspect the container is intended to be used according to any one of the preceding aspects and/or made according to the procedure according to any one of the preceding aspects to contain cigarettes, the container being a packet of cigarettes.

BRIEF DESCRIPTION OF THE DRAWINGS

Some embodiments and some aspects of the invention will be described below with reference to the accompanying drawings, provided by way of indication and therefore not by way of limitation, in which.

DEFINITIONS AND CONVENTIONS

Figure 1:
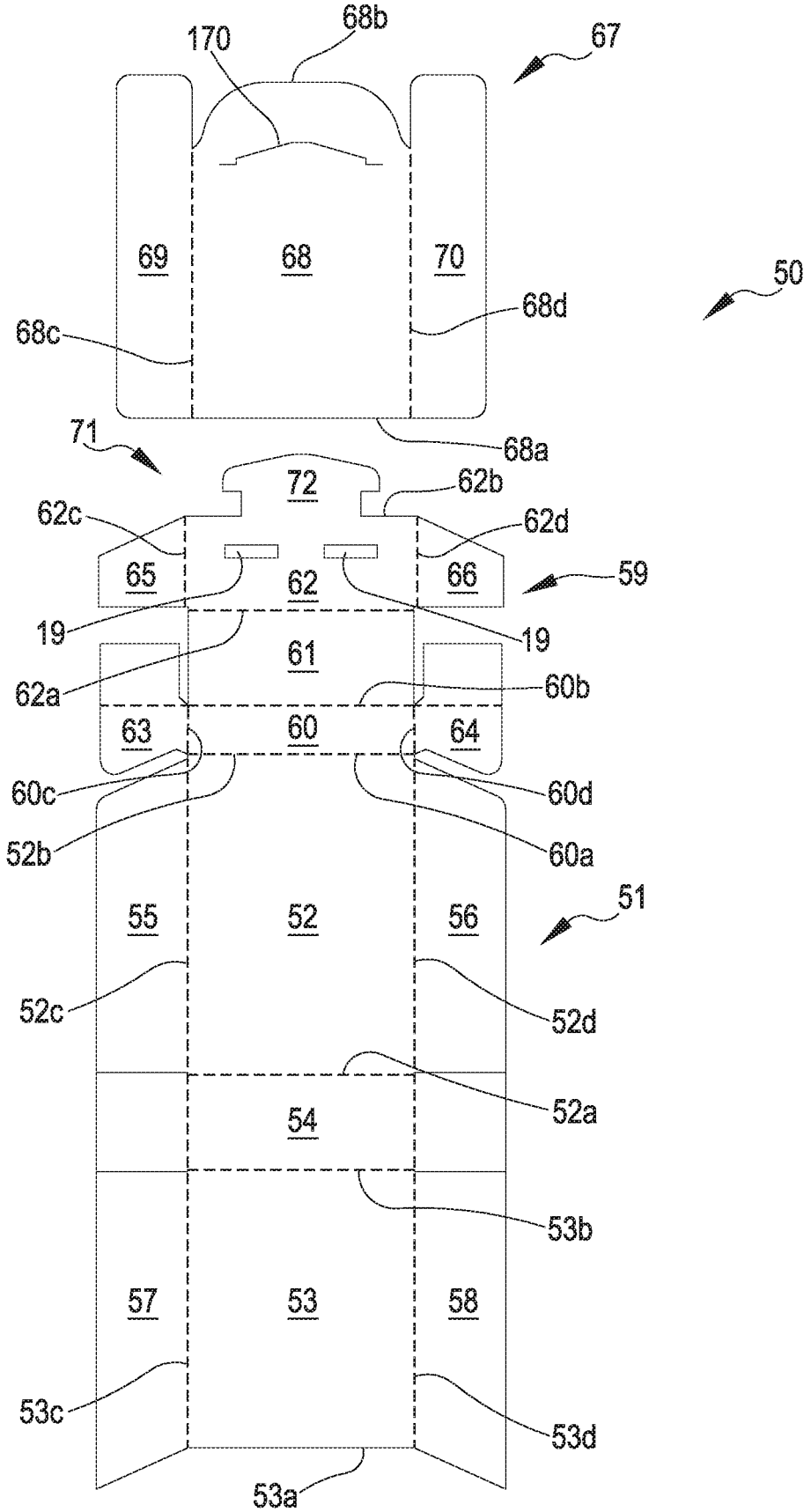
FIG. 1 shows a blank configured to define a container according to an first embodiment.

It should be noted that in the present detailed description, corresponding parts shown in the various Figures are indicated with the same reference numerals. The Figures may show the object of the invention by means of not-to-scale representations; therefore, parts and components shown in the Figures relating to the object of the invention may exclusively relate to diagrammatic representations.

In the context of this description, the use of terms such as 'top', 'bottom', 'bottom', 'side', 'side', 'horizontal', 'vertical', 'front', 'front', 'front', 'rear', 'rear', 'rear' and the like refers, unless otherwise stated, to at least one condition of normal use/take of the container, namely a normal handling of the container by a user.

The term product means an article or a compound of articles of any kind. For example, the product may be of the type containing tobacco, such as a cigarette or cigar, or of the type suitable for use with a product containing tobacco.

The term paper material means paper or cardboard, for example at least 50% by weight, optionally at least 70% by weight, of organic material comprising one or more cellulose, hemicellulose, lignin, lignin derivatives. The paper material may be in sheet material with a weight between 100 and 500 g/m$^2$. The paper sheet material may be covered at least partially by a plastic coating, for example a film, the purpose of which is to: reinforce the paper sheet material, define a barrier to water and/or moisture. The coating can be between 10 and 50 μm thick and made of one or more of the following materials: LDPE, HDPE, PP, PE.

The term blank means a flat semi-finished product made of sheet material, for example paper sheet material, which can be folded back on itself to make a container. The blank can be in a single piece and can be obtained by die-cutting a single sheet.

Bent blank folding configuration of the blank means a configuration in which the blank is folded to form the container.

The term sheet material means a material with two dimensions, for example length and width, which are significantly larger than a third dimension such as thickness.

DETAILED DESCRIPTION

Container

A childproof container is indicated with 1. The container 1 comprises a type of closure and an unlocking portion, which will be described in detail below, which allow the container 1 to be opened only under certain conditions and in particular to prevent it from being opened by children.

The container 1 comprises a store 2 defining a compartment 3 configured to house one or more products. In more detail, the store 2 comprises a prefixed number of walls and has a substantially parallelepipedic shape. As illustrated in the enclosed figures, store 2 can have a substantially rectangular parallelepiped shape. The store can comprise, in its parallelepipedic form, a front wall 4*a*, a rear wall 4*b* opposite the front wall 4*a*, a first side wall 4*c* between the front wall 4*a* and the rear wall 4*b* and a second side wall 4*d* opposite the first side wall 4*c*: the first side wall 4*c* and the second side wall 4*d* are interposed between the front wall 4*a* and the rear wall 4*b* by opposite parts of the store 2 and connect the front wall 4*a* and the rear wall 4*b* at opposite longitudinal edges. The store 2 may also include a rear wall 4*e* to delimit the compartment 3 below. Alternatively, the store 2 may include a number of side walls other than four. The bottom wall 4*e*, the front wall 4*a*, the rear wall 4*b* and the side walls 4*c*, 4*d* cooperate to define a concavity of the compartment 3 facing towards the external environment.

The front wall 4*a*, the rear wall 4*b* and the side walls 4*c*, 4*d* define at least one passage opening 5 delimited by a free edge 6. The free edge 6, as well as the passage opening 5, is defined as opposed to bottom wall 4*e*. The passage opening 5 is configured to connect the compartment 3 of the store 2 with the external environment. The enclosed figures show the container 1 with a single passage opening 5;

however, it is not excluded the possibility of creating, for example, a the store 2 without a bottom wall and with two openings defined at the opposite longitudinal ends of the store 2.

As can be seen in the attached figures, the store 2 can extend longitudinally along a direction of prevalent development, along which a length of the store 2 is defined. The store 2 can be suitably sized according to the type of product and the quantity of product to be contained in the store 2. The container 1 may be of small dimensions, namely it may have a store 2 with a compartment 3 whose volume is substantially comprised between 40,000 and 200,000 $mm^3$. The container 1 may be used for the packaging of medium-sized products; in this condition, the store 2 may have a compartment 3 whose volume is greater than 500,000 $mm^3$, and optionally between 800,000 and 1,400,000 $mm^3$. However, the possibility of using the containers 1 for the packaging of large-sized products is not excluded; in such a case, the store 2 may have a compartment 3 whose volume is greater than the volumes specified above, for example more than 10,000 $cm^3$.

Figure 9:
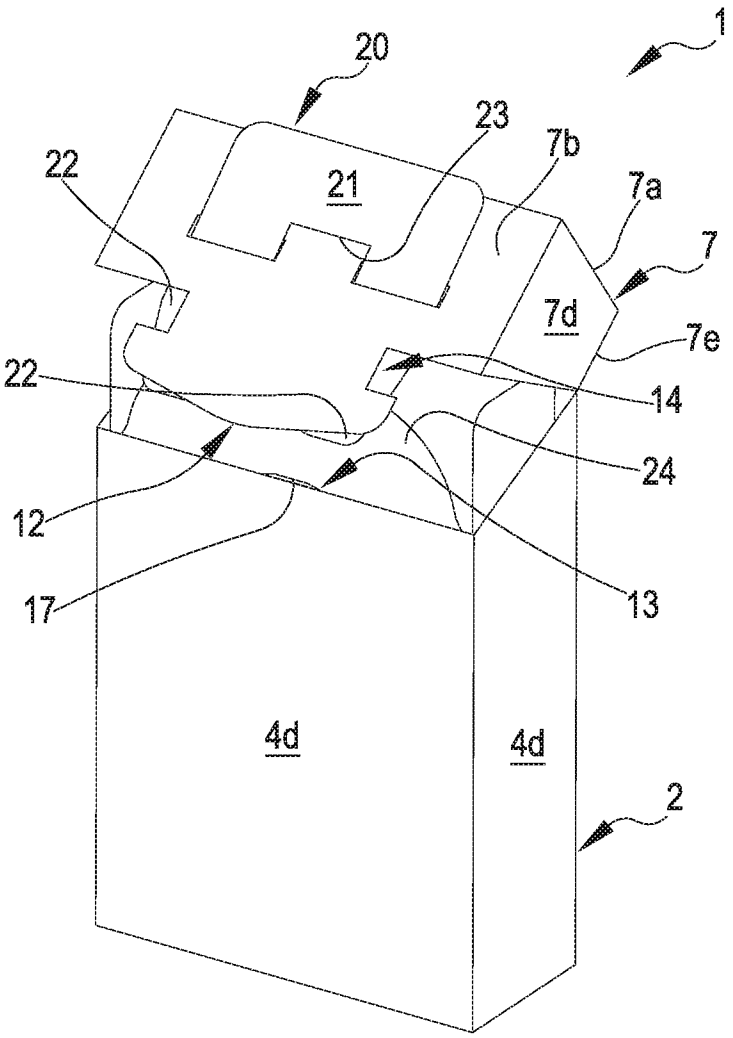
FIG. 9 is a frontal perspective view of the container showing a phase of the container opening method in FIG. 7 in which the closure system is in the opening condition and the opening device is engaged at the unlocking portion.
Figure 8:
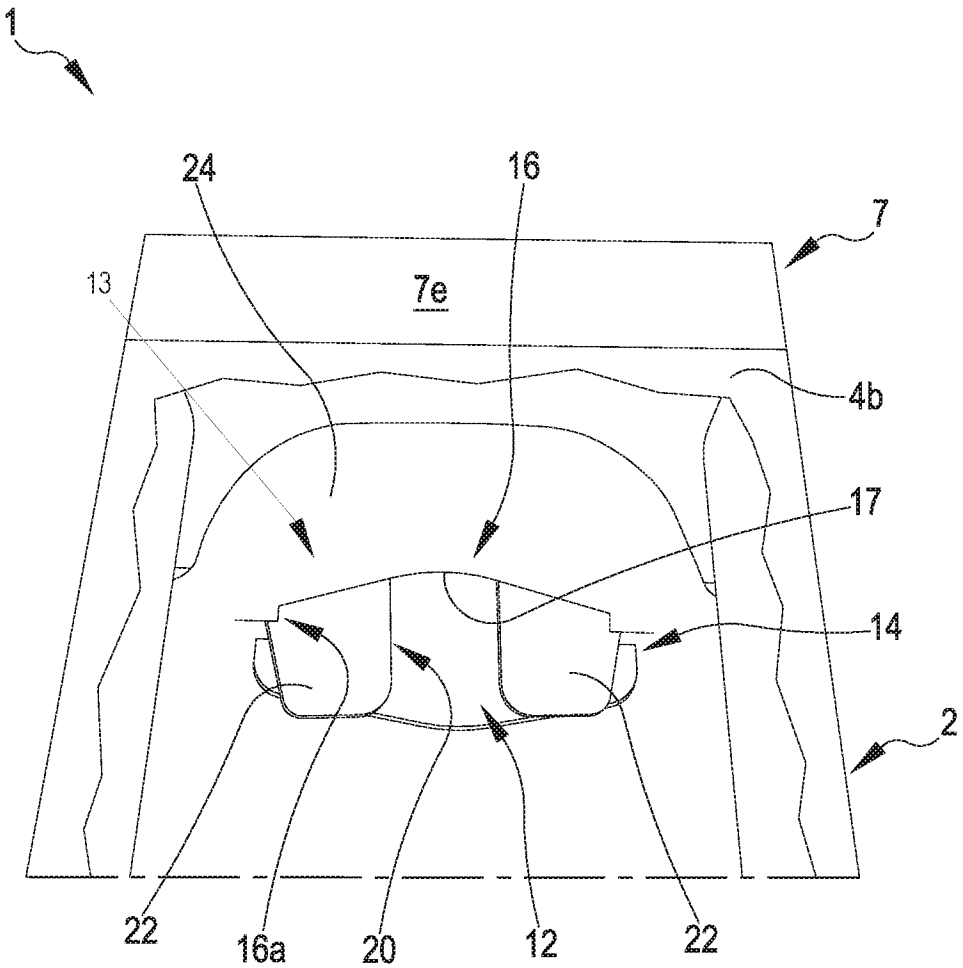
FIG. 8 is a detail view of a cross-section of the container in FIG. 7 where part of the rear wall has been removed to illustrate a step in the method of opening the container in FIG. 7 where the opening device acts on the safety device to unlock it.
Figure 13:
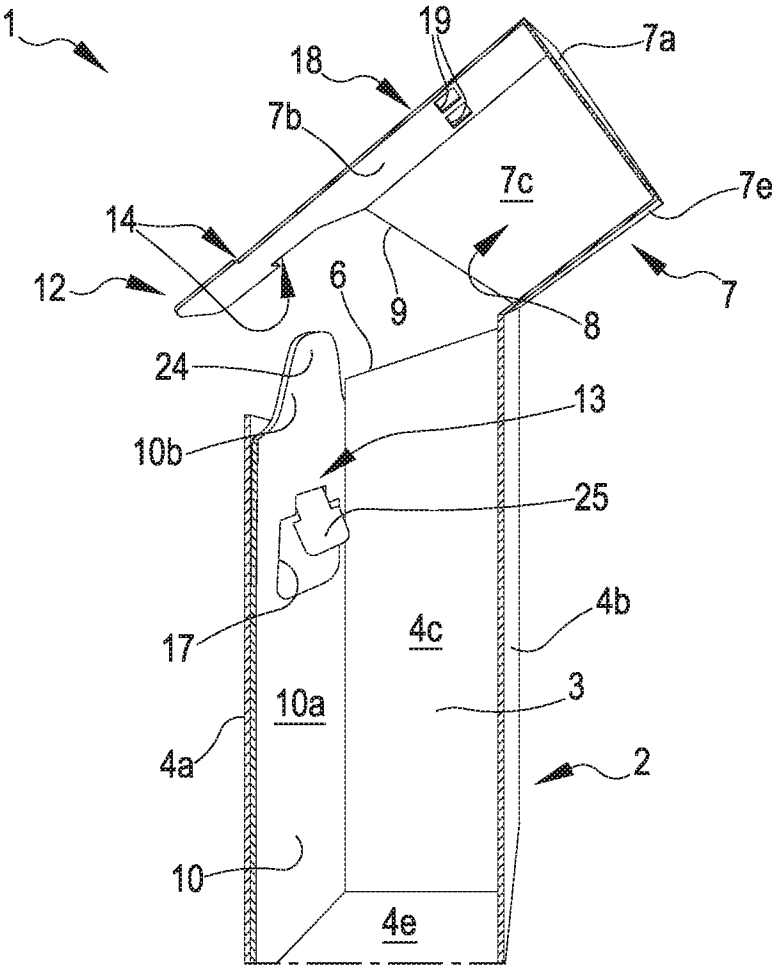

As can be seen from the attached figures, the container 1 also comprises at least one closure system 7, optionally joined together in one piece, at the rear wall 4*b* of the store 2 at the free edge 6 and movable in relation to the store 2. In particular, the closure system 7 is hinged to the free edge 6 of the store 2 and movable by rotation in relation to the latter. The closure system 7 is configured to define at least one locking condition (see for example FIGS. 4, 5, 6, 16, 19) and at least one opening condition (see for example FIGS. 2, 9 and 13). In the closing condition, the closure system 7 prohibits the communication between the passage opening 5 and the external environment and consequently between the compartment 3 and the external environment, while in the closing condition the closure system 7 is configured to allow the communication between the passage opening 5 and the external environment and consequently between the compartment 3 and the external environment. From a functional point of view, the closure system 7 essentially represents a lid suitable for cooperating with the store 2 in order to manage access to the compartment 3. In a possible embodiment in which the container 1 comprises a number of passage opening 5, the container 1 may include a closure system 7 for each passage opening 5 in the store 2.

In more detail, the closure system 7 comprises a top panel 7*a*, a front panel 7*b* and a first and second side panel 7*c*, 7*d*. The first and second side panels 7*c*, 7*d* emerge from opposite parts of the top panel 7*a* to essentially define the sides of closure system 7. The front panel 7*b* emerges frontally from top panel 7*a* in between the first and second side panel 7*c*, 7*d*. The closure system 7 may also include a rear panel 7*e* engaged at the free edge 6 of the store 2. As illustrated in the attached figures, the rear panel 7*e* of the closure system 7 may be the only constraint of the closure system 7 to the free edge 6 of the store 2. The engagement between the rear panel 7*e* and the free edge 6 of the store 2, for example engaged by means of a hinge-type constraint, allows the rotation of the closure system 7 between the closed and the opening condition, and vice versa. The rear panel 7*e* emerges from the top panel 7*a* on the opposite side to the front panel 7*b* in interposition between the first and second side panel 7*c*, 7*d*. In other words, the rear panel 7*e* emerges at the rear from top panel 7*a*. In the closure condition of the closure system 7, the top panel 7*a*, the front panel 7*b*, the first side panel 7*c*, the second side panel 7*d* and the rear panel 7*e* cooperate to interdict the access to compartment 3. In structural terms, top panel 7*a*, the front panel 7*b*, the first side panel 7*c*, the second side panel 7*d* and, where provided, the rear panel 7*e*, shall cooperate to define a compartment 8 of the closure system bounded by a respective free edge 9 and having a concavity facing, in the closing condition of the closure system 7, towards the compartment 3 of the store 2. In the closing condition of the closing system 7, the concavities of the compartment 3 of the storage unit and the compartment 8 of the closing system 7 shall be opposite each other: the compartment 3 of the storage unit 2 and the compartment 8 of the closing system 7 shall cooperate to define an internal volume of the container 1.

The container 1 also comprises a panel 10 engaged to the front wall 4*a* of the store 2. The panel 10 is located in the compartment 3 and faces the rear wall 4*b* of the store 2. The panel 10 straddles the free edge 6 of the store 2; in other words, the panel 10 comprises a basic portion 10*a* extending below the free edge 6 of the store 2, namely between the bottom wall 4*e* and the free edge 6 of the store 2, and an end portion 10*b* extending beyond the free edge 6 of the store 2. The end portion 10*b* is joined to the base portion 10*a*.

The container 1 also comprises at least one safety device 11 having at least a first coupling portion 12 carried by the front panel 7*b* of the closure system 7 and at least a second coupling portion 13 engaged to the front wall 4*a* of the store 2. The first and second coupling portion 12, 13 are configured to stably engage each other during a locking condition of the closure system 7 (see for example FIGS. 4, 6 and 16). In the closing condition of the closure system 7, the safety device 11, and consequently the container 1, assumes a locking condition in which the opening of the container 1 is prevented by the engagement between the first and second coupling portion 12, 13.

Figure 4:
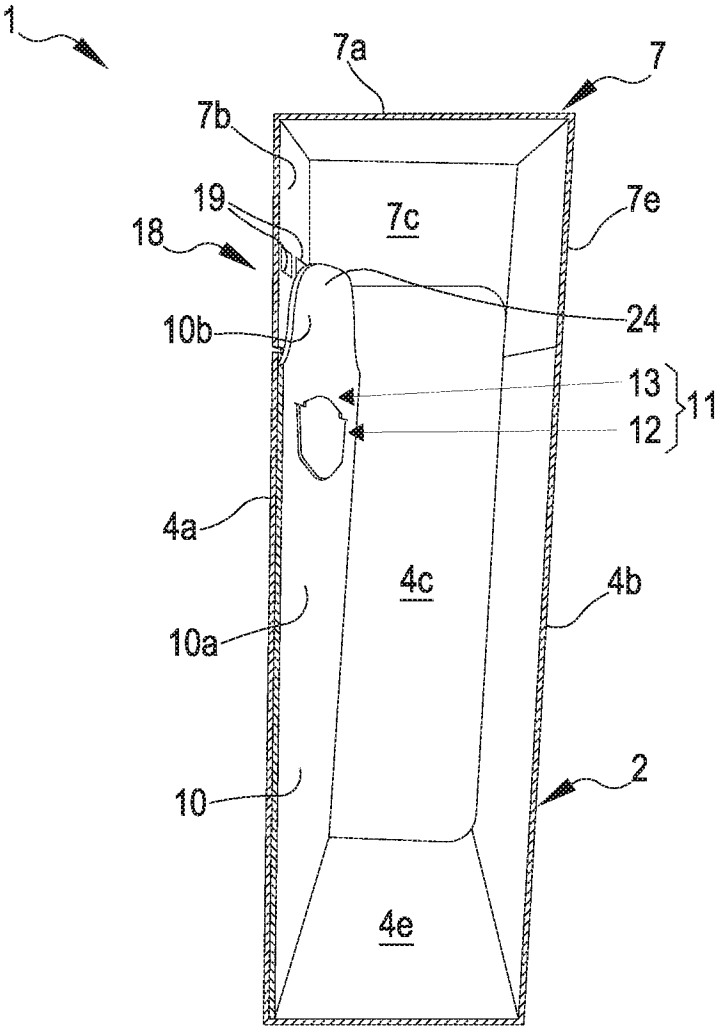
FIG. 4 is a sectional view of the container of FIG. 2, wherein the closure system is in the closing condition.
Figure 6:
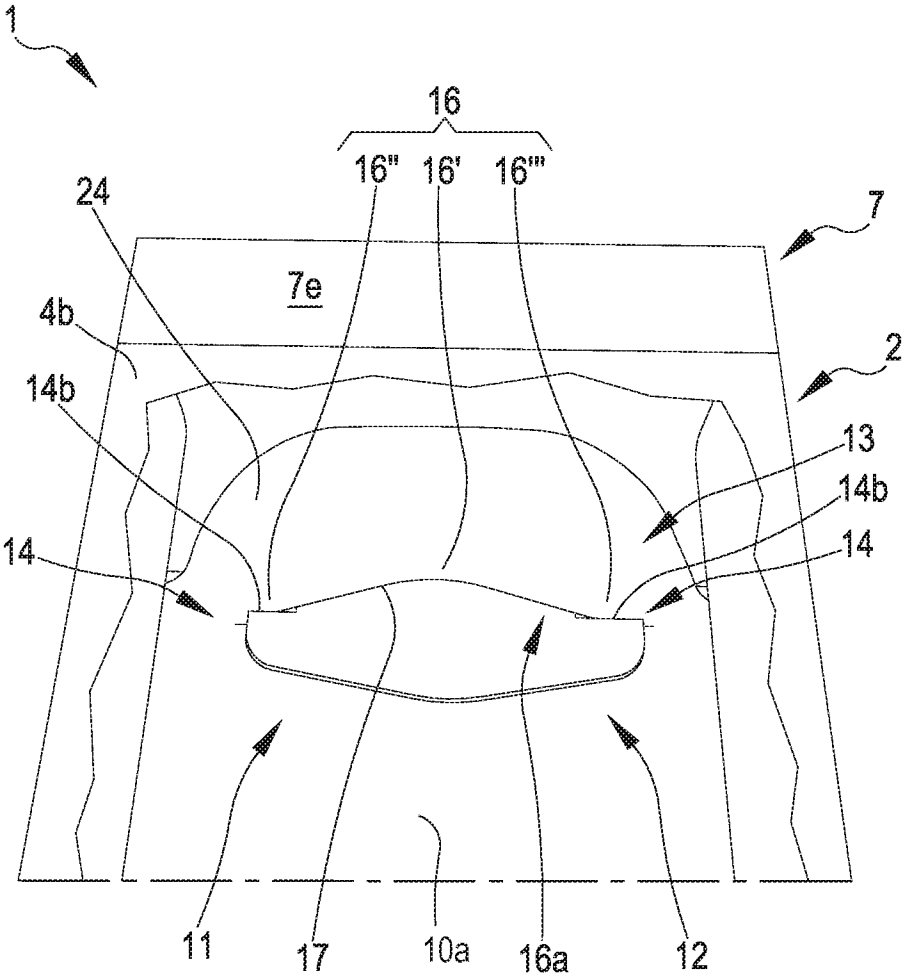
FIG. 6 is a detail view of a cross-section of the enclosure in FIG. 5, wherein part of the rear wall has been removed to illustrate the locking condition of the safety device.

With regard to the first coupling portion 12, in the closing condition of the closure system 7, it is configured to fit at least partially into the compartment 3 of the store 2 in order to stably engage the second coupling portion 13. As shown in FIGS. 4 and 6, in the closing condition of the closure system 7, the first coupling portion 12, in the closing condition of the closure system 7, is entirely contained in the internal volume of the container 1 and it is spaced from the free edge 6 of the store 2. In addition, in the closing condition of the closure system 7, the engagement between the second coupling portion 13 and the first coupling portion 12 is completely defined in the internal volume of the container 1. The engagement between the first and second coupling portion 12, 13 is of reversible type; in other words, after reaching the opening condition of the closure system 7, the first and second coupling portion 12, 13 may be engaged again to define again the closing condition of the closure system 7 and consequently a new locking condition of the safety device 11. This is possible because, when switching between the closing and the opening condition, the first coupling portion 12 is simply disengaged from the second coupling portion 13. In other words, according to the embodiments of the container 1 shown in the attached figures, during the passage between the closing condition and the opening condition, the first and second coupling portion 12, 13 are not removed or detached respectively from the closure system 7 and the store 2, but remain engaged to the latter's. In this way, since no removable portions are provided of the safety device 11, the first and second coupling portions 12, 13 are configured to reversibly define, following every opening condition of the closure system 7, a locking condition in which these portions 12, 13 are stably engaged with each other.

Figure 14:
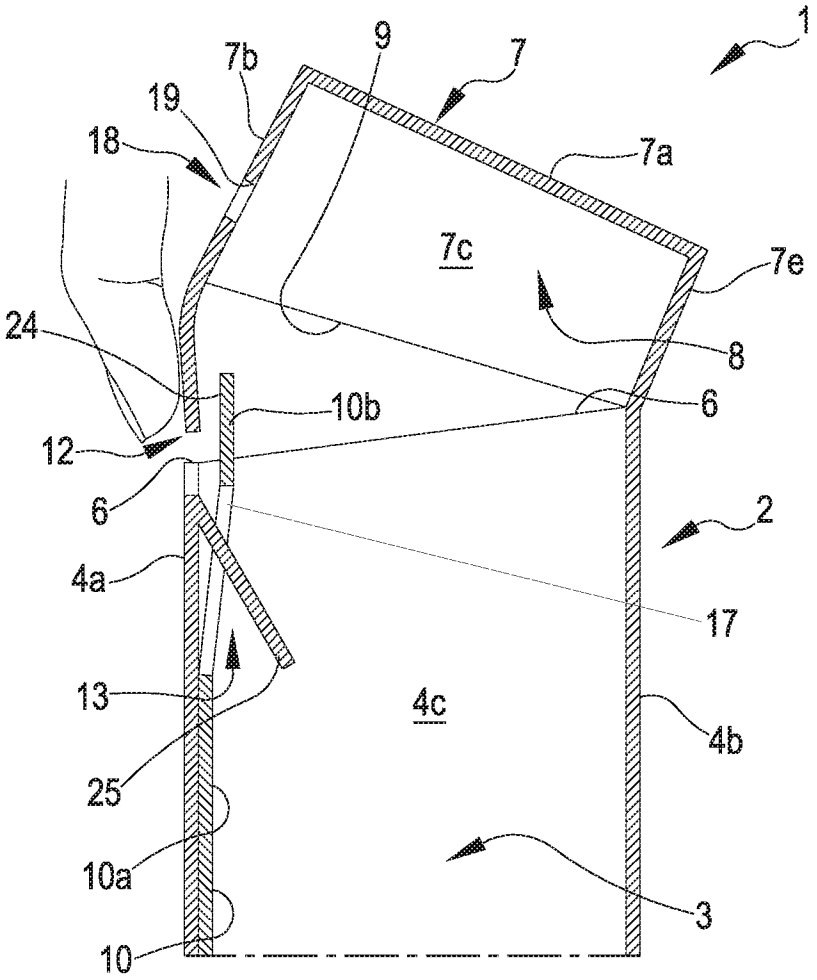
FIGS. 13-16 are different section views of the container according to the second embodiment.

The attached figures illustrate the embodiments of the container 1 in which the first coupling portion 12 is engaged in the front panel 7*b* of the closure system 7. The first coupling portion 12 and the front panel 7*b* can be joined together to form a single body. In the embodiments shown in the attached figures, the first coupling portion 12 and front panel 7*b* are joined together in one piece and the first coupling portion 12 comprises a flat sheet body coplanar to the front panel 7*b*. In the embodiments shown in the attached figures, the first coupling portion 12 is made of paper sheet material and is elastically deformable. FIG. 14 illustrates a deformation condition of the first coupling portion 12 which is generated by the push of a user's finger on the same portion 12 to allow its insertion inside the compartment 3 of the store 2 and the engagement to the second coupling portion 13.

Figure 2:
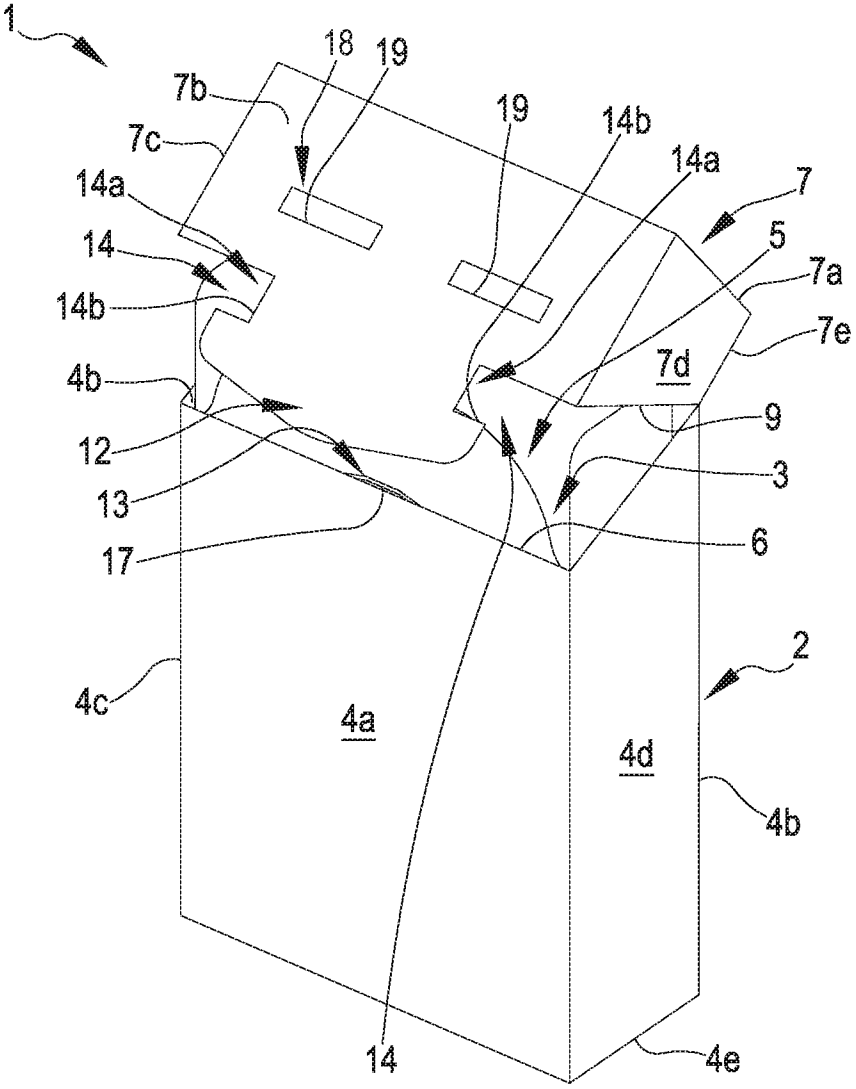
FIG. 2 is a frontal perspective view of a container according to the first embodiment, wherein the closure system is in the opening condition.
Figure 5:
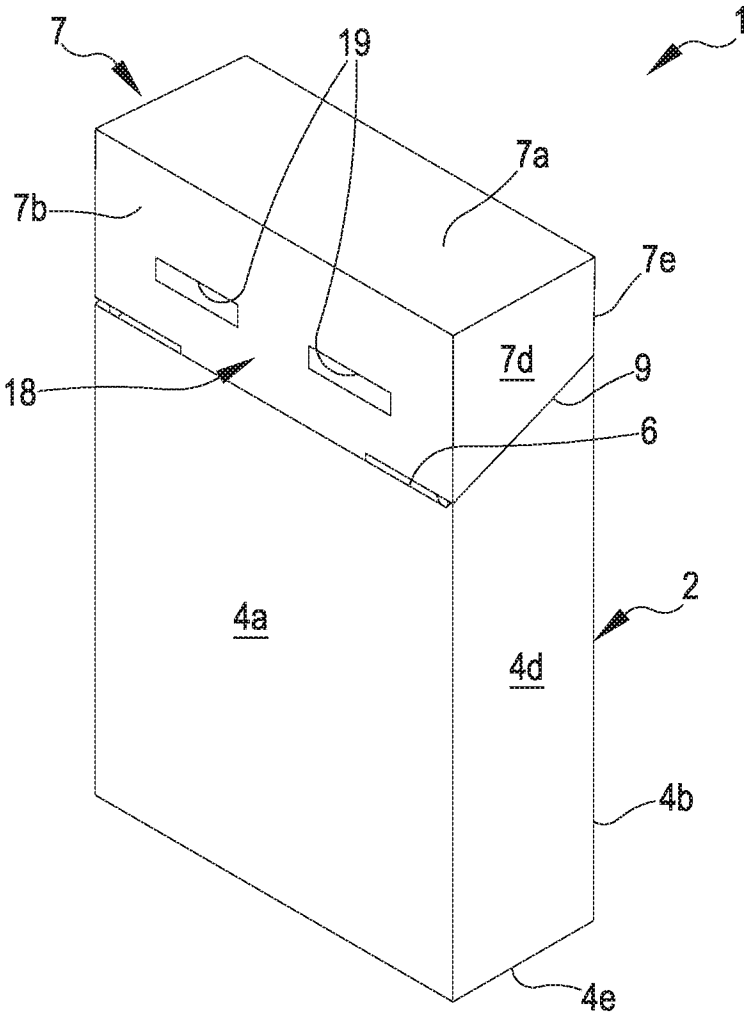
FIG. 5 is a frontal perspective view of the container according to the first embodiment, wherein the closure system is in the closing condition.

In more detail, the first coupling portion 12 has at least one hook 14 configured to stably engage the second coupling portion 13 located inside the store 2 in the closing condition of the closure system 7. As illustrated in the accompanying figures, the hook 14, in the closing condition of the closure system 7, is distinct and spaced from the free edge 6 of the store 2. As illustrated in FIG. 2, the hook 14 defines an undercut 14*a* having a seat a 14*b* with a concavity. As illustrated in the attached figures, the first coupling portion 12 may comprise two hooks 14 with respective undercuts 14*a* and respective seats 14*b* whose concavities are opposite each other. The undercut 14*a* of the hook 14 is configured to engage the second coupling portion 13, as will be seen in more detail below.

Figure 3:
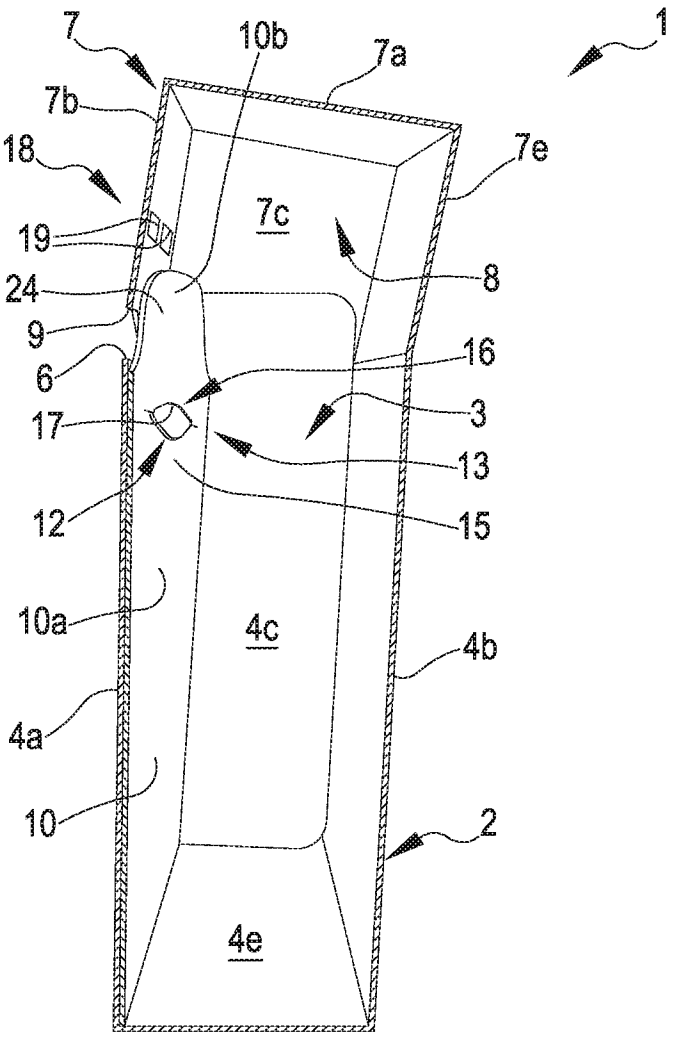
FIG. 3 is a sectional view of the container of FIG. 2 showing a closing phase of the container in which the closure system is in an intermediate condition between the open and the closing condition.

As shown in the attached figures, the second coupling portion 13 is defined at the base portion 10*a* of the panel 10. The second coupling portion 13 comprises a main body 15 and a hook 16 engaged to the main body 15. The hook 16 is configured to allow the engagement of the hook 14 of the first coupling portion 12 to the second coupling portion 13 in the locking condition of the safety device 11. Between the hook 16 and the main body 15 is defined as a passage seat 17 having a concavity facing opposite the free edge 6 of the store 2; the passage seat 17 is at least partially bounded by the hook 16. In the attached figures, a passage seat 17 is shown whose concavity points towards the bottom wall 4*e* of the store 2. The passage seat 17 basically defines a window in the panel 10 act to allow the insertion of the first coupling portion 12; the first coupling portion 12 is inserted in passage seat 17 (see FIG. 3 illustrating the phase of insertion of the first coupling portion 12 in passage seat 17) to be guided in engagement to the second coupling portion 13 (see FIG. 6 illustrating the closing condition of the closure system 7). As illustrated for example in FIGS. 3, 4, 6 and 8, the passage seat 17 may be formed by a notch defined on the second coupling portion 13 between the main body 15 and the hook 16.

From a structural point of view, the hook 16 comprises a central body 16' and a first and second connecting ends 16",16'" opposed to the central body 16' (FIG. 6). The first and second connecting ends 16", 16'" develop laterally to the central body 16', which is therefore interposed between them, and constrain the central body 16' to the main body 15 of the second coupling portion 13.

The central body 16' and the first and second connecting ends of the 16", 16'" define an undercut 16*a* of the hook 16 and delimit the passage opening 17. The passage seat 17 allows the undercut 14*a* of the first coupling portion 12 to engage the undercut 16*a* of the second coupling portion 13 in the locking condition of the safety device 11; the locking condition is illustrated for example in FIG. 6.

The container 1 also comprises at least an unlocking portion 18. The unlocking portion 18 is defined at the front panel 7*b* of the closure system 7. The unlocking portion 18 is configured to allow the closure system 7 to switch from the closing condition to the opening condition. The unlocking portion 18 is configured to define at least a through access 19. The through access 19 allows the access, under certain conditions and by means of appropriate opening devices detailed below, to the internal volume of the container 1 to operate on the closure system 7 to allow the passage of closure system 7 from the closing condition to the opening condition. The through access 19 is distanced from the free edge 9 of the closure system 7 and shall be spaced from the top panel 7*a* of the closure system 7. The through access 19 is configured to allow, in the locking condition of the safety device 11, the insertion of an opening device 20 into the inner volume of the compartment of the container 1. The opening device 20 is designed to allow the disengagement between the first and second coupling portion 12, 13 and consequently the passage of the closure system 7 from the closing condition to the opening condition. The through access 19 is perimetrically delimited by a closed path profile developing completely on the front panel 7*b* of the closure system 7. The closed path profile delimits a free passage section of the through access 19. The free passage section may be suitably sized to allow easy insertion of the opening device 20. Optionally, the free passage section of through access 19 is at least partially counter shaped the opening device 20. As illustrated in the attached figures, the through access 19 is defined in correspondence of a portion of the front panel 7*b* intended to be facing, in the closing condition of the closure system 7, to the extremal portion 10*b* of panel 10. The attached figures illustrate embodiments in which the unlocking portion 18 has two through accesses 19 having the same rectangular profile, spaced out each other and defined completely in correspondence with the front wall 7*b* of the closure system 7 at the same distance from the top panel 7*a*. In possible variants, the number of the through accesses 19 may differ from two, the profile of the through accesses 19 may differ in shape or size and the through accesses 19 may be located at different distances from the top panel 7*a*.

Figure 7:
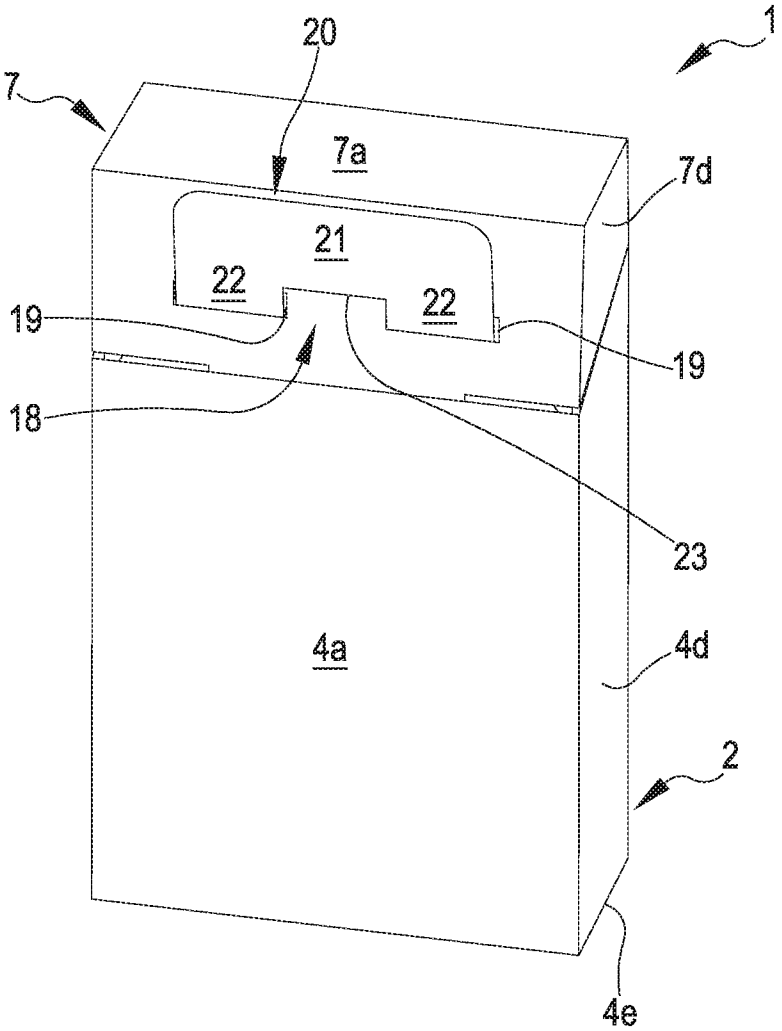
FIG. 7 is a frontal perspective view of the container of FIG. 5 in which an opening device has been inserted through an unlocking portion of the container.

The container 1 may include an opening device 20. The opening device 20 may have one or more of the characteristics described above. The opening device 20 is configured to allow the passage of the closure system 7 from the closing condition, corresponding to the locking condition of safety device 11, to the opening condition. The opening device 20 can therefore ensure the opening of the container 1 by operating on the safety device 11 in such a way as to determine the disengagement between the first and second coupling portion 12, 13. The opening device 20 may be supplied to a user together with the container 1. In this embodiment, the free passage section of the through access 19 and the opening device 20 may be at least partially counter-shaped from each other. The opening device 20 is dimensioned and designed to be inserted, in the closing condition of the closure system 7, at least partially into the internal volume of the container 1 through the through access 19. The opening device 20 may be made of paper sheet material; however, the opening device 20 may be made of other materials, such as plastic sheet or metal sheet material. From a structural point of view, the opening device 20 has a gripping portion 21 from which one or more appendices 22 emerge (see, for example, FIGS. 7 and 9). The appendices 22 may have a polygonal shape, for example substantially square or rectangular or trapezoidal. The appendices 22 are configured and dimensioned to fit inside a respective through access 19 in such a way that they are guided to the safety device 11, to contact, in the closing condition of the closure system 7, the first and the second coupling portion 12, 13 and to disengage them. The appendices 22 are developed away from a stop edge 23 interposed between them. The stop edge 23 allows the opening device 20 to enter, in the closing condition of the closure system 7, partially into the internal volume of the container 1, in such a way that the appendices 22 are arranged inside the volume of the container 1 while the gripping portion 21 remains outside the container 1. At a condition of maximum penetration of the opening device 20 into the inner volume of the container 1, the stop edge 23 may be at the stop with a section of the unlocking portion 18 interposed between the through access 19; said section acts as a stop limit for the opening device 20 and prevents the opening device 20 from entering completely, in the closing condition of the closure system 7, the inside volume of the container 1. The opening device 20 may have substantially shaped 'C' or 'U' or 'W' or 'H' or 'A'.

The container 1 also comprises a guide body 24. The guide body 24 is configured to guide, in the closing condition of closure system 7, the opening device 20 towards the safety device 11. For this purpose, the guide body 24 is arranged with respect to the through access 19 in such a way that it is contacted, for example by the appendix 22 of the opening device 20, when inserting the opening device 20 into the internal volume of the container 1, by the opening device 20. In other words, the guide body 24 is arranged in such a way that it is intercepted by the opening device 20 when it is inserted into the internal volume of the container 1; by intercepting the opening device 20, the guide body 24 directs the opening device 20 towards the safety device 11. In particular, the guide body 24 is arranged in such a way that a plurality of possible inserting directions of the opening device 20 into the inner volume of the container 1 intercept the guide body 24. With reference to the closing condition of the closure system 7, the guide body 24 is placed in the internal volume of the container 1 and faces the unlocking portion 18; in more detail, the guide body 24 develops in the compartment 8 of the closure system 7 (see FIG. 3). The guide body 24 can be directly facing the through access 18. Providing that guide body 24 faces the unlocking portion 18, and in particular directly facing the through access 19, allows the guide body 24 to guide, in the closing condition of the closure system 7, the opening device 20 to the safety device 11. The guide body 24 is made of sheet material and is carried by at least one between the second coupling portion 13 and the closure system 7. The attached figures illustrate the embodiments of the container 1 in which the guide body 24 is carried by the second coupling portion 13. The guide body 24 can develop at the extremal portion 10*b* of the panel 10 and can therefore be defined as the portion of the panel 10 that emerges beyond the free edge 6 of the container 2. The guide body 24 therefore develops at a greater height, defined as the distance from the bottom wall 4*e*, to the height at which the free edge 6 of the storage 2 develops. Under the functional point of view, the guide body 24 basically defines a ramp, with respect to which the opening device 20 can slide or slide towards the safety device 11. In order to guide the opening device 20 towards the safety device 11 to work on it, the guide body 24 is facing and positioned behind the through access 19; in that regard see FIG. 16.

As will be described in detail below with reference to the method of opening the container 1, the guide body 24 guides the opening device 20 towards the first coupling portion 12 of the safety device 11 in such a way as to contact it and consequently allow the disengagement from the second coupling portion 13.

Figure 15:
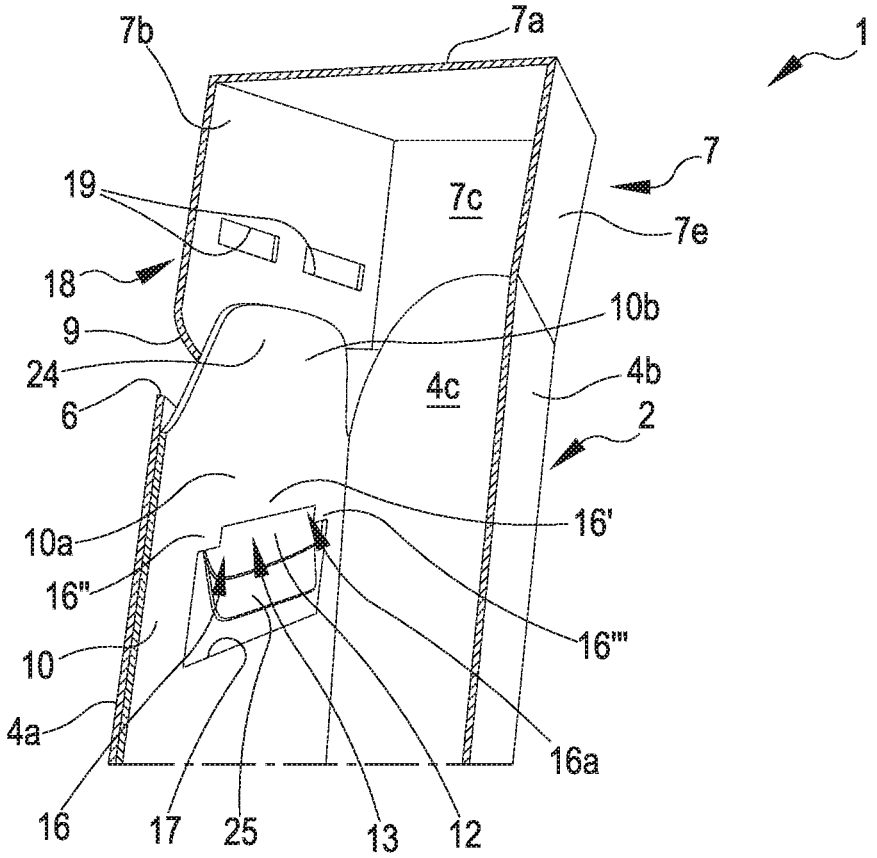
Figure 16:
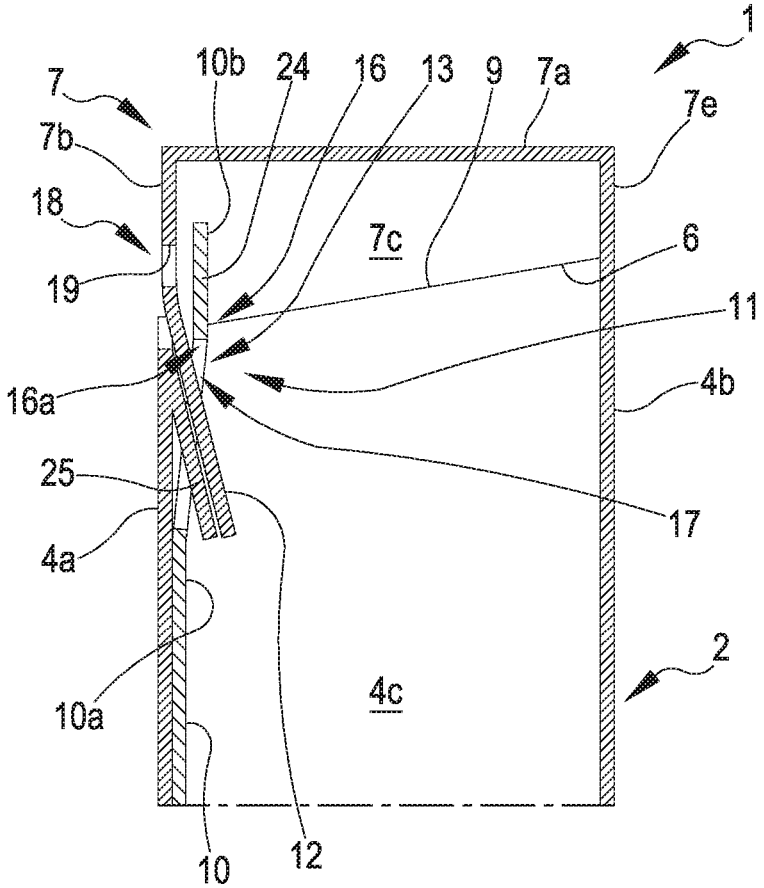

The container 1 may also include a pushing device 25; in that regards see for example FIGS. 13 to 16. the pushing device 25 is placed in the compartment 3 of the storage unit 2 near the second coupling portion 12. The pushing device 12 shall be configured to allow the engagement between the first and second coupling portion 12, 13 and, in the locking condition of the first and second coupling portion 12, 13, keep the safety device 11 in the locking condition. For this purpose, the pushing device 25 is configured to act in push on at least one of the first and second coupling portions 12, 13. As shown in FIGS. 13 to 16, the pushing device 25 is configured to act in push on the first coupling portion 12. The pushing device 25 passes through the passage seat 17 of the hook 16 of the second coupling portion 13; this arrangement allows the pushing device 25 to operate on the first coupling portion 12. The pushing device 25 is of the elastically deformable type. As shown in the attached figures, the pushing device 25 is elastically movable between a thrusting and a resting condition. In the thrusting condition the pushing device 25 operates in push on the first coupling portion 12, in the closing condition of the closure system 7, to maintain the first coupling portion 12 in engagement on the second coupling portion 13. The pushing device 25, on the other hand, assumes the resting condition in the opening condition of the closure system 7, in which the pushing device is not stressed by the first coupling portion 12. FIG. 15 shows an operating condition of the container 1 intermediate between the opening condition of the closure system and the closing condition of the closure system 7; this intermediate operating condition is reached by the movement of the closure system starting from the closing condition and provides the partial insertion of the first coupling portion 12 into the passage seat 17. In the configuration of FIG. 15, the pushing device 25 is placed inside the passage seat 17 and operates, in the thrusting condition, on the first coupling portion 12, which results wedged between the pushing device 25 and the second coupling portion 13. FIG. 16 illustrates the closing condition of the closure system 7 which, with reference to the passage of the closure system 7 from the opening to the closing condition, is subsequent to the configuration illustrated in FIG. 15 with reference to a closing operation of the container 1. In the closing condition, the pushing device 25 is in the thrusting condition and operates in push on the first coupling portion 12 in order to maintain it engaged with the second coupling portion 13 in order to maintain the locking condition of the safety device 11. Upon transition of the container 1 from the intermediate condition shown in FIG. 15 to the closing condition of the closure system 7 shown in FIG. 16, the pushing device 25 acts on the hook 14 of the first coupling portion 12 to move it away from the front wall 4*a* and allowing the step engagement at the hook 16 of the second coupling portion 13. In the locking condition of the safety device 11 thus reached, the undercut 14*a* of the hook 14 of the first coupling portion 12 and the undercut 16*a* of the hook 16 of the second coupling portion 13 are attested to each other. From a structural point of view, the pushing device 25 comprises a tab made of sheet material. In order to provide elasticity to the pushing device 25 to allow its elastic movement as described above, the tab may be made of paper sheet material. In possible variations, the tab 25 may be made of elastically deformable material different from paper sheet material. The tab 25 is joined in one piece to the front wall 4*a* of the store 2. The tab 25 is joined in one piece to the free edge 6 of the store 2 and is folded around the free edge 6 in such a way that it results placed inside the passage seat 17 in front of the panel 10. The positioning of the tab 25 inside the passage seat 17 defined on the panel 10 can help prevent the spring-back of the tab 25 after it has been folded over the free edge 6 of the store 2. As shown in the attached figures and with reference to a lateral section of the container 1, in the resting condition, the tab 25 assumes with respect to a front wall 4*a* of the store 2 a first angular position (see FIG. 14) with a certain angular width, while in the thrusting condition, the tab 25 assumes with respect to a front wall 4*a* of the store 2 a second angular position (see FIG. 16) having a respective angular width smaller than the angular width that the tab 25 assumes in the first angular position. The tab 25 is elastically movable between the first and the second angular position by means of the first coupling portion 12; for example, the tab 25 is elastically movable between the first and the second angular position when inserting the first coupling portion 12 into the passage seat 17 (see FIG. 15), while it is movable from the second to the first angular position when disengaging the first coupling portion 12 from the second coupling portion 13.

Figure 18:
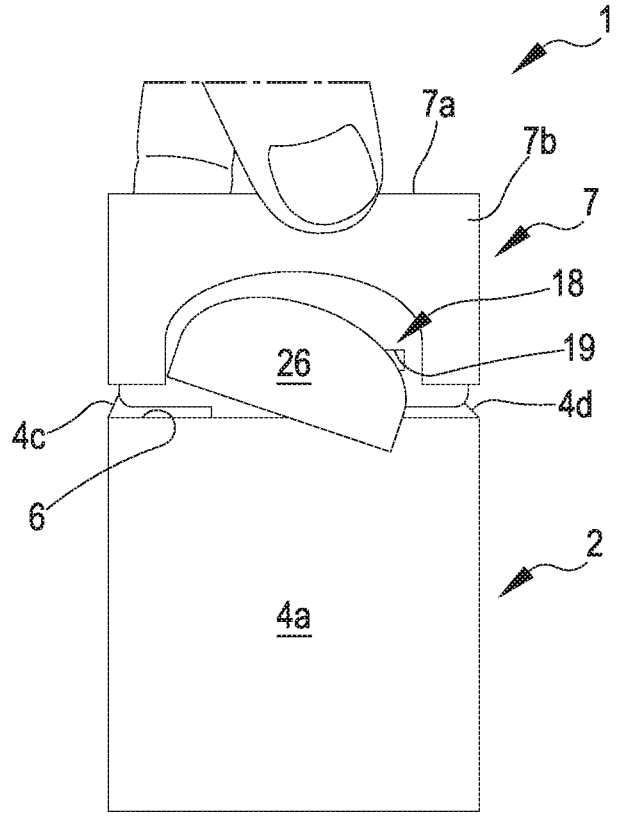
FIG. 18 shows the container according to the third embodiment during a first opening phase during which a tamper evident portion is removed by opening the closure system.
Figure 19:
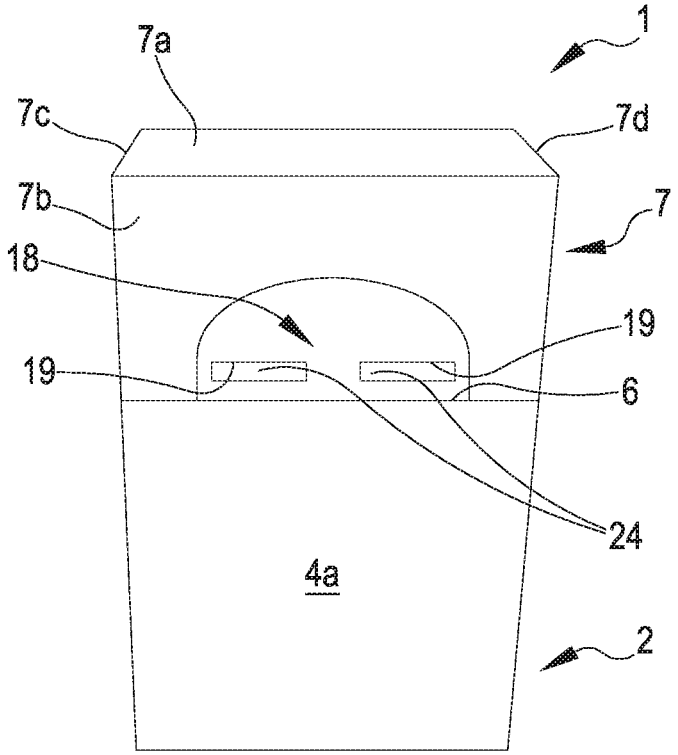
FIG. 19 is a frontal perspective view of the container according to the third embodiment in a condition subsequent to the first opening of the container, in which the closure system is in the closing condition and the tamper evident portion has been removed.

As shown in FIG. 18, the container 1 may include a tamper evident portion 26. The tamper evident portion 26 is configured to operate between an intact condition and a violated condition (see FIG. 19). In the intact condition the tamper evident portion 26 prevents access to the through access 19, while in the violated condition the tamper evident portion 26 allows access to the through access 19, for example to allow the opening of the container 1 by the opening device. The tamper evident portion 26 assumes the intact condition in an unbroken condition of the container 1 in which the container 1 has not yet been opened for the first time, while at the first opening or first attempt to open the container 1, the tamper evident portion 26 is configured to pass non-reversibly from the intact condition to the violated condition. FIG. 18 shows the transition of the tamper evident portion 26 from the intact condition to the violated condition. The tamper evident portion 26 comprises a removable portion that can be associated with the unlocking portion 18. In the intact condition, the removable portion 26 is engaged frontally to the unlocking portion 18 in such a way as to occlude the through access 19, while in the violated condition the removable portion 26 is at least partially removed from the unlocking portion 18 and allows the access to the through access 19. The removable portion 26 may include a removable panel, such as a tear-off panel (see FIG. 18). In another possible embodiment, the removable portion 26 may include a plastically deformable membrane, such as a fracturable membrane.

Method of Opening the Container

This invention also relates to a method of opening a container 1 according to any one of the accompanying claims.

The method of opening the container 1 involves the preparation of the container 1 according to any one of the embodiments described above. The previously prepared the container 1 has the closure system in closing condition. If the container has no through access, the method of opening the container 1 involves the definition of at least a through access 19 on the unlocking portion 18. The phase of defining at least one through access 19 may involve releasing the through access 19, for example by removing a removable panel act to occlude the through access 19;

the removable panel may, for example, be counter-shape to the through access 19. The method involves the at least partial insertion of the opening device 20 through the through access 19. The at least partial insertion of the opening device 20 involves the insertion of at least an appendix 22 within the respective through access 19. In case the two appendices 22 are provided, the at least partial insertion of the opening device 20 involves the insertion of each appendix 22 within the respective through access 19. The method may involve inserting the opening device 20 into the inner volume of the container 1 through the through access 19 until a condition of maximum penetration of the opening device 20 into the inner volume of the container 1 is reached; said step involves bringing in hammering the stop edge 23 of the opening device 20 with a section of the unlocking portion 18 interposed between the through accesses 19. The configuration for inserting the opening device 20 into the inner volume of the container 1 is exemplarily shown in FIG. 7 and FIG. 8. When the opening device 20 is inserted into container 1, the opening device 20 contacts the guide body 24, which guides the opening device 20 towards the safety device 11. Under the guidance of the guide body 24, the opening device 20 reaches the safety device 11 and contacts at least one between the first coupling portion 12 and the second coupling portion 13 to disengage the first and second coupling portion 12, 13. According to the embodiments of the container 1 shown in the attached figures, the guide body 24 is configured to guide the opening device 20 towards the safety device 11 such that it contacts the first coupling portion 12. in the following will be described the embodiments of the method in which the opening device 20 contacts the first coupling portion 12 to unlock the safety device 11; however, in a possible variant, the method may involve contacting the second coupling portion 13 to unlock the safety device 11 or both the first coupling portion 12 and the second coupling portion 13. The guide body 24 guide the opening device 20 in interposition between the first portion of coupling 12 and the passage seat 17; in said condition, illustrated as an example in FIG. 8, the appendices 22 of the opening device 20 are interposed between the first coupling portion 12 and the passage seat 17. The interposition of the opening device 20 between the first coupling portion 12 and the passage seat 17 makes it possible to disengage an undercut 14*a* of the first coupling portion 12 from an undercut 16*a* of the second coupling portion 13. In the embodiment of the method involving the provision of a the container 1 comprising the pushing device 25, such as the container 1 shown in Figures from 13 to 16, when the opening device 20 is inserted into the internal volume of the container 1, the method involves, at the stage when the opening device 20 is placed in interposition between the first coupling portion 12 and the passage seat 17, to overcome an elastic thrust exerted by the pushing device 25 on the first coupling portion 12 in such a way as to disengage the undercut 14*a* of the first coupling portion 12 from the undercut 16*a* of the second coupling portion 13. After disengaging the first coupling portion 12 from the second coupling portion 13, the method involves moving by rotation the closure system 7 with respect to the store 2. Said phase may involve moving the opening device 20 integrally with the closure system 7, optionally by rotation; in this respect, see FIG. 9.

An embodiment of the method that provides for the preparation of the container 1 with a tamper evident portion 26, in order to determine the opening of the container 1 the method provides, at the time of a first opening of the container 1 or a first attempt to open the container 1, to non-reversibly determine the passage of the tamper evident portion 26 from the intact condition to the violated condition in such a way as to make accessible the through access 19.

Said step is prior to the phase of the at least partial insertion of an opening device 20 through the through access 19 and may involve removing a removable portion 26 or tearing a tearable portion from the unlocking portion 18 and, in addition or alternatively, plastically deforming a membrane, for example by fracturing it.

Blank

The present invention also relates to a blank 50 in paper sheet material from which it is possible to make a container 1 according to any of the accompanying claims. The procedure for making a container 1 from the respective blank 50 is detailed in the following of the present description.

The blank 50 comprises at least a first sheet 51. The first sheet 51 comprises at least a first and a second portion 52, 53 interconnected by a central connecting portion 54. The first portion 52, the second portion 53 and the central connecting portion 54 are aligned along a connecting direction. The first and the second portion 52, 53 comprise at least two opposite extremal edges 52*a*, 52*b*, 53*a*, 53*b* and two opposite longitudinal edges 52*c*, 52*d*, 53*c*, 53*d*.

Figure 12:
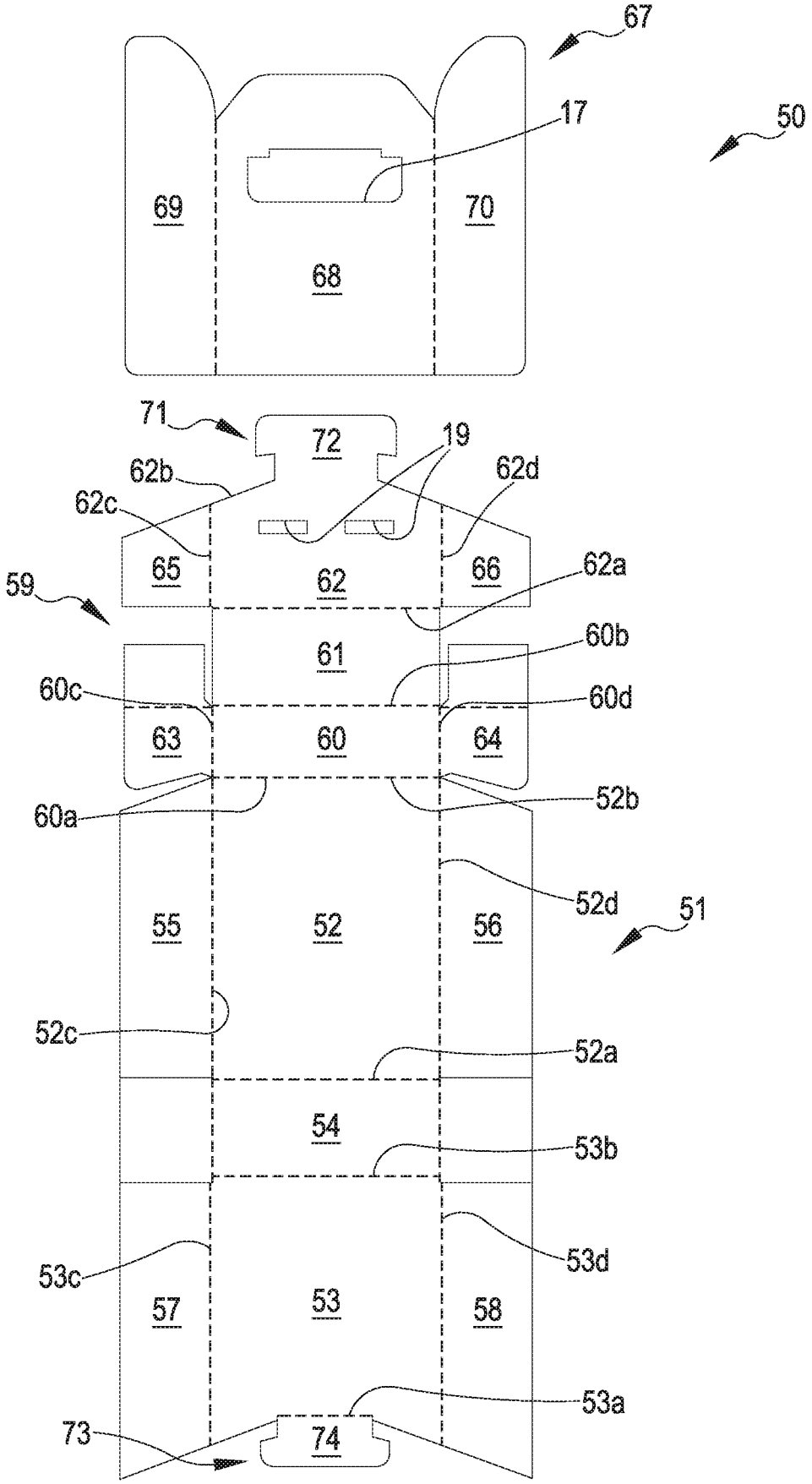
FIG. 12 shows a blank configured to define a container according to a second embodiment.

As shown in FIGS. 1 and 12, the central connecting portion 54 is joined to the first and the second portions 52, 53 along respective opposite extremal edges 52*a*, 53*b*; in said figure, the connecting direction along which the first portion 52, the second portion 53 and the central connecting portion 54 are aligned is transverse to the extremal edges 52*a*, 52*b*, 53*a*, 53*b* of the first and the second portions 52, 53. The first sheet 51 also comprises a first and a second lateral connecting portion 55, 56 joined to the first portion 52 along respective longitudinal edges 52*c*, 52*d* opposed. The first sheet 51 also comprises a third and a fourth lateral connecting portion 57, 58 joined to the second portion 53 along respective longitudinal edges 53*c*, 53*d* opposed. The first sheet 51 is configured to form the store 2 of the container 1, as detailed below; respectively, the first portion 52 is configured to form the rear wall 4*b*, the second portion 53 is configured to form the front wall 4*a*, the central connecting portion 54 is configured to form the bottom wall 4*e* and the first and third connecting portion 55, 57 are configured to form, in cooperation, the first side wall 4*c* and the second and fourth lateral connecting portion 56, 58 are configured to form, in cooperation, the second side wall 4*d* of the store 2.

The blank 50 also comprises a second sheet 59 connected to an extremal edge 52*b* of the first portion 52 of the first sheet 51. The second sheet 59 comprises a first, a second and a third portion 60, 61, 62 joined together in one piece. The first and third portions 60, 62 comprise at least two opposite extremal edges 60*a*, 60*b*, 62*a*, 62*b* and at least two opposite longitudinal edges 60*c*, 60*d*, 62*c*, 62*d*. The extremal edge 60*a* of the first portion 60 of the second sheet 59 may coincide substantially with the extremal edge 52*b* of the first portion 52 of the first sheet 51. The first portion 60 of the second sheet 59 is interposed between the first portion 52 of the first sheet 51 and the second portion 61 of the second sheet 59 and the second portion 61 of the second sheet 59 is interposed between the first portion 60 of the second sheet 59 and the third portion 62 of the second sheet 59. The third portion 62 of the second sheet 59 is joined in one piece to the second portion 61 of the second sheet 59. The third portion 62 of the second sheet 60 has at least one through access 19 or a portion configured to define a through access 19. The first, the second and the third portions 60, 61, 62 of the second sheet 60 are configured to form the rear panel 7*e*, the top panel 7*a* and the front panel 7*b* of the closure system 7 of the container 1, respectively. The second sheet 59 may also comprise a fourth portion 63 and a fifth portion 64 joined to the first portion 60 at opposite longitudinal edges 60*c*, 60*d*. The second sheet 59 may also comprise a sixth portion 65 and a seventh portion 66; in the blanks of FIGS. 1 and 12, the sixth and the seventh portions 65, 66 of the second sheet 59 are joined to the third portion 62 at the opposite longitudinal edges 62*c*, 62*d* of the third portion 62 of the second sheet 59. In the blank 50 of FIGS. 1 and 12, the sixth portion 65 develops near the fourth portion 63 and the seventh portion 66 develops near the fifth portion 64. The fourth and sixth portions 63, 65 of the second sheet 59 are configured to form, in cooperation, the first side panel 7*c* of the closure system 7, while the fifth and seventh portions 64, 66 of the second sheet 59 are configured to form, in cooperation, the second side panel 7*d* of the closure system 7.

The blank 50 also comprises a third sheet 67. As shown in FIG. 1 and FIG. 12, the third sheet 67 can be separated from the first sheet 51 and the second sheet 59. The third sheet 67 comprises a first portion 68 having at least two opposite end edges 68*a*, 68*b* and two opposite longitudinal edges 68*c*, 68*d*. The third sheet 67 comprises a first and a second lateral connecting portion 69, 70 joined to the first portion 68 of the third sheet 67 along respective opposite longitudinal edges 68*c*, 68*d*. The third sheet 67 is configured to form the panel 10 and then to form the second coupling portion 13 of the safety device 11 and the guide body 24. The third sheet 67 comprises a window (see FIG. 12) 17 or a notch 170 (see FIG. 1) configured to define, under operating conditions of the container, a window; the window corresponds to the passage seat 17 described above.

The blank 50 also comprises a fourth sheet 71. The fourth sheet 71 comprises at least one portion 72 joined in one piece to the third portion 62 of the second sheet 59. The fourth sheet 71 is configured to form the first coupling portion 12 of the safety device 11.

As shown in FIG. 12, the blank 50 can also include a fifth sheet 73 joined in one piece to the first sheet 51. The fifth sheet 73 comprises at least a portion 74 connected to an extremal edge 53*c* of the second portion 53 of the first sheet 51 opposite the extremal edge 53*b* to which the central connecting portion 54 is connected. The fifth sheet 73 is configured to form pushing device 25.

Figure 17:
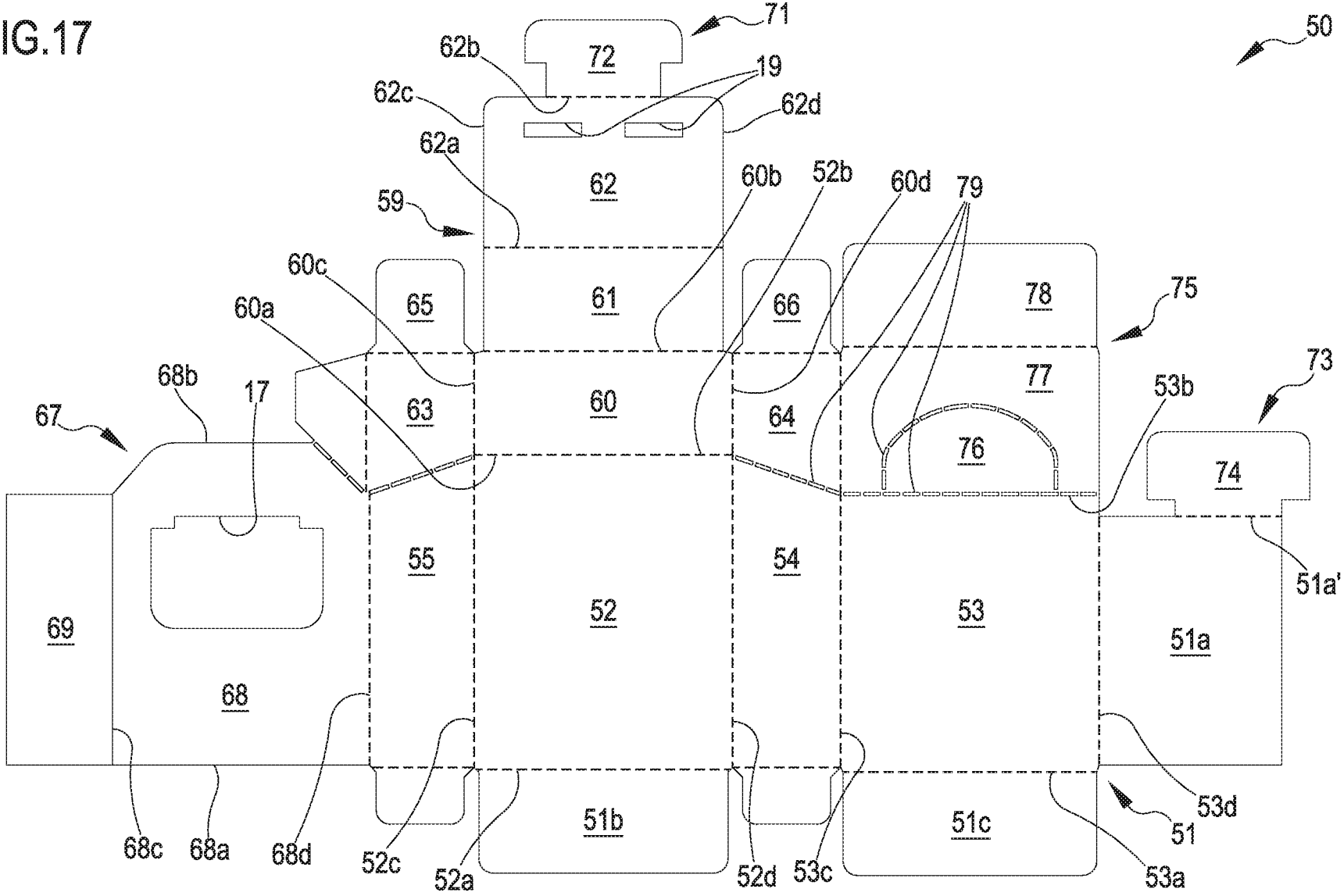
FIG. 17 shows a rough cut configured to define a container according to a third embodiment.

Unlike the blanks 50 in FIGS. 1 and 12, the blanks 50 in FIG. 17 provide a central connecting portion 54 of the first sheet 51 joined to the first and second portions 52, 53 along respective longitudinal edges 52*c*, 52*d* opposite. In blank 50 of FIG. 17, the connecting direction along which the first portion 52, the second portion 53 and the central connecting portion 54 of the first sheet 51 are aligned is transversal to the longitudinal edges 52*c*, 52*d*, 53*c*, 53*d* of the first and second portions 52, 53. The first sheet 51 of the blank 50 in FIG. 17 comprises a single lateral connecting portion 55 joined to the first portion 52 of the first sheet 51 along a longitudinal edge 52*c* opposite the longitudinal edge 52*d* of the first portion 52 to which the central connecting portion 54 is joined. The first sheet 51 also comprises a tilting portion 51*a* joined to the second portion 53 along a longitudinal edge 53*d* opposite the longitudinal edge 53*c* of the second portion 53 to which the central connecting portion 54 is joined. The first sheet 51 also comprises a third portion 51*b* joined in one piece to the extremal edge 52*a* of the first portion 52 opposite the extremal edge 52*b* to which the first portion 60 of the second sheet 59 is joined and a fourth portion 51*c* joined to an extremal edge 53*a* of the second sheet 53; the fourth portion 51*c* is placed on the same side of the first sheet 51 as the third portion 51*b* of the first sheet 51. The first sheet 51 is configured to form the store 2 of the container 1, as detailed below; respectively, the first portion 52 is configured to form the rear wall 7*b*, the second portion 53 and the tilting portion 51*a* are configured to form, cooperating with each other and with the first portion 68 of the third sheet 67, the front wall 7*a*, the side connection portion 55 is configured to form the first side wall 7*c*, the central connecting portion 54 is configured to form, cooperating with the lateral connecting portion 69 of the third sheet 67, the second side wall 7*d* and the third and the fourth portion 51*b*, 51*c* are configured to form, cooperating, the bottom wall 4*e* of the store 2.

In the blank 50 of FIG. 17, the sixth portion 65 of the second sheet 59 is carried by the fourth portion 63 of the second sheet 59 and the seventh portion 66 of the second sheet 59 is carried by the fifth portion 64 of the second sheet 59. The fourth portion 63 of the second sheet 59 is configured to form the first side panel 7*c* of the closure system 7, the fifth portion 64 of the second sheet 59 is configured to form the second side panel 7*d* of the closure system 7, while the sixth and seventh portions 65, 66 of the second sheet 59 are configured to form, cooperating with the second portion 61 of the second sheet 59, the top panel 7*a* of the closure system 7.

In the blank of FIG. 17, the third sheet 67 is in one piece with the first sheet 51 and is joined to the first sheet 51 along a longitudinal edge 68*d* of the first portion 68 of the third sheet 67. The third sheet 67 also comprises a lateral connecting portion 69 joined to the first portion 68 of the third sheet 67 along the longitudinal edge 68*c* of the first portion 68 of the third sheet 67 opposite the longitudinal edge 68*d* to which the first sheet 68 is joined. The first portion 68 of the third sheet 67 is configured to cooperate with the second portion 53 of the first sheet 51 and with the tilting portion 51*a* of the first sheet 51 to form the front wall 4*a* of the store 2, while the side connecting portion 69 of the third sheet 68 is configured to cooperate with the central connecting portion 54 of the first sheet 51 to form the second side wall 4*d* of the store 2.

In the blank of FIG. 17, the fifth sheet 73 comprises at least a portion 74 connected to an extremal edge 51*a*' of the tilting portion 51 of the first sheet 51. The fifth sheet 73 is one piece with the first sheet 51 and emerges from the tilting portion 51*a* on the same side of the first sheet 51 from which the second sheet 59 emerges.

The blank 50 of FIG. 17 also comprises a sixth sheet 75 at least partially connected to an extremal edge 53*b* of the second portion 53 of the first sheet 51. The sixth sheet 75 comprises a first portion 76, a second portion 77 and a third portion 78. The second portion 77 is interposed between the first portion 76 and the third portion 78. The first portion 76 can be a weakened portion and can be connected to an extremal edge of the first sheet 51 and the second portion 77 along respective weakening lines 79. The sixth sheet 75 is configured to form the tamper evident portion 26. Optionally, the first portion 76 is configured to form a removable panel 26, such as a tear-off panel.

The blank 50 may also include a seventh sheet. The seventh sheet may be separated from the first, second, third, fourth, fifth and sixth sheets 51, 59, 67, 71, 73, 75. Alternatively, the seventh sheet may be in one piece with at least one of the first, second, third, fourth, fifth or sixth sheets 51, 59, 67, 71, 73, 75, for example along a weakening line along which the seventh sheet may be removed from at least one other sheet 51, 59, 67, 71, 73, 75. The seventh sheet comprises at least a portion configured to form the opening device 20. The seventh sheet may be detachable, for example along the said weakening line, to enable the opening device 20 to be prepared.

The blank 50 can be in paper sheet material. In detail, each of the sheets 51, 59, 67, 71, 73, 75 of blank 50 described above can be in paper sheet material.

Container Manufacturing Procedure

Furthermore, it is an object of the present invention a procedure for making a container 1 according to any of the accompanying claims. The container 1 made by said process is of the type described above.

The container 1 is made from a single sheet of blank 50, for example in paper material, of the type described above. As will be seen in detail below, the procedure involves folding the blank 50 and the connection of some of its portions, for example by gluing, to form the container 1.

The procedure for manufacturing a container 1 involves the arrangement of a blank 50 of the type previously described. Optionally, the process may include the arrangement of at least one product. The procedure may involve the preparation of several products, for example the type containing tobacco, such as cigarettes or cigars, or the type suitable for use with a product containing tobacco.

The process of making a container 1 starting from the blank of FIGS. 1 and 12 is now described.

Figure 10:
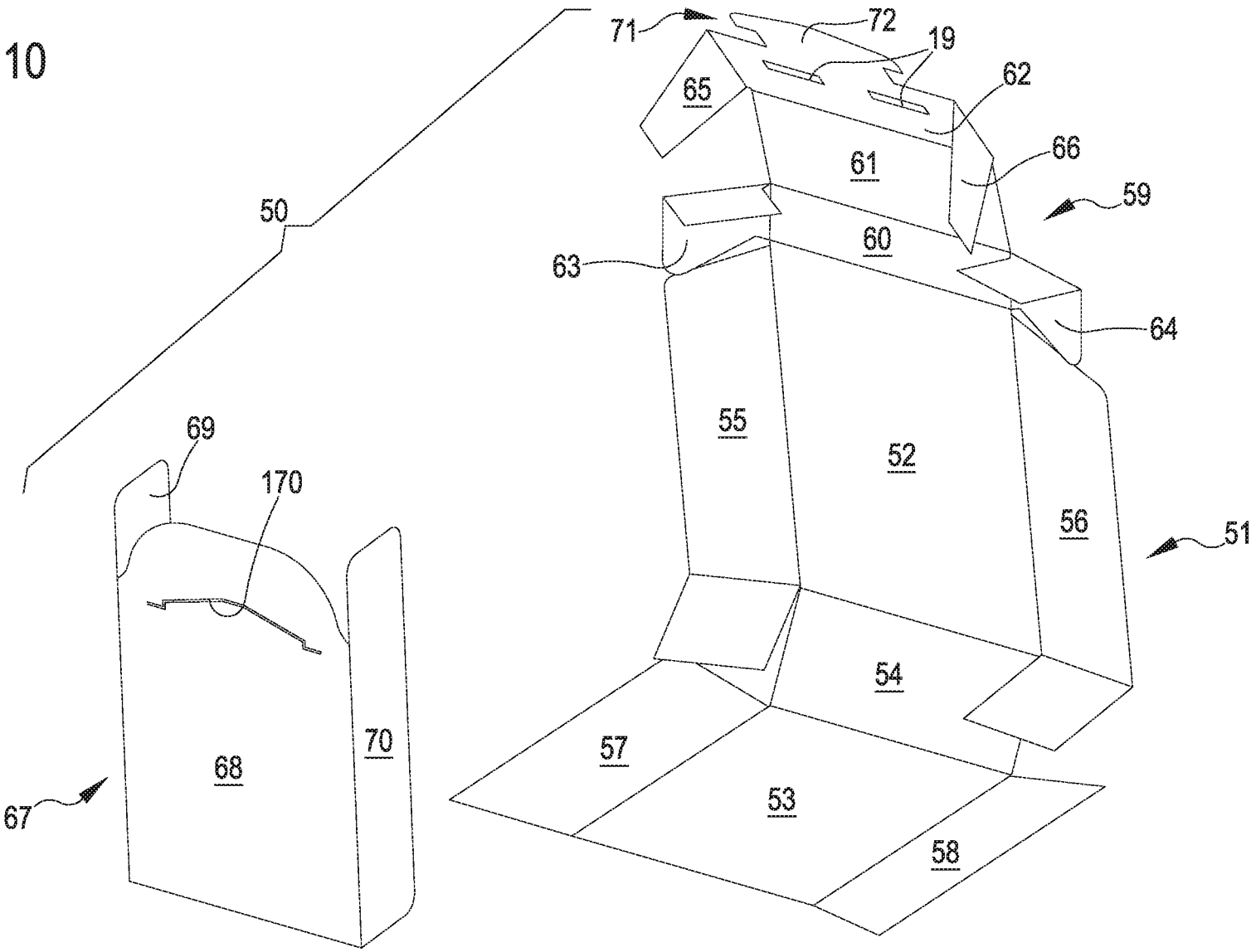
FIG. 10 shows schematically a folding phase of the blank of FIG. 1 for the realization of the container according to the first embodiment, FIG. 11 schematically shows a further phase of a procedure for the construction of the container according to the first embodiment.
Figure 11:
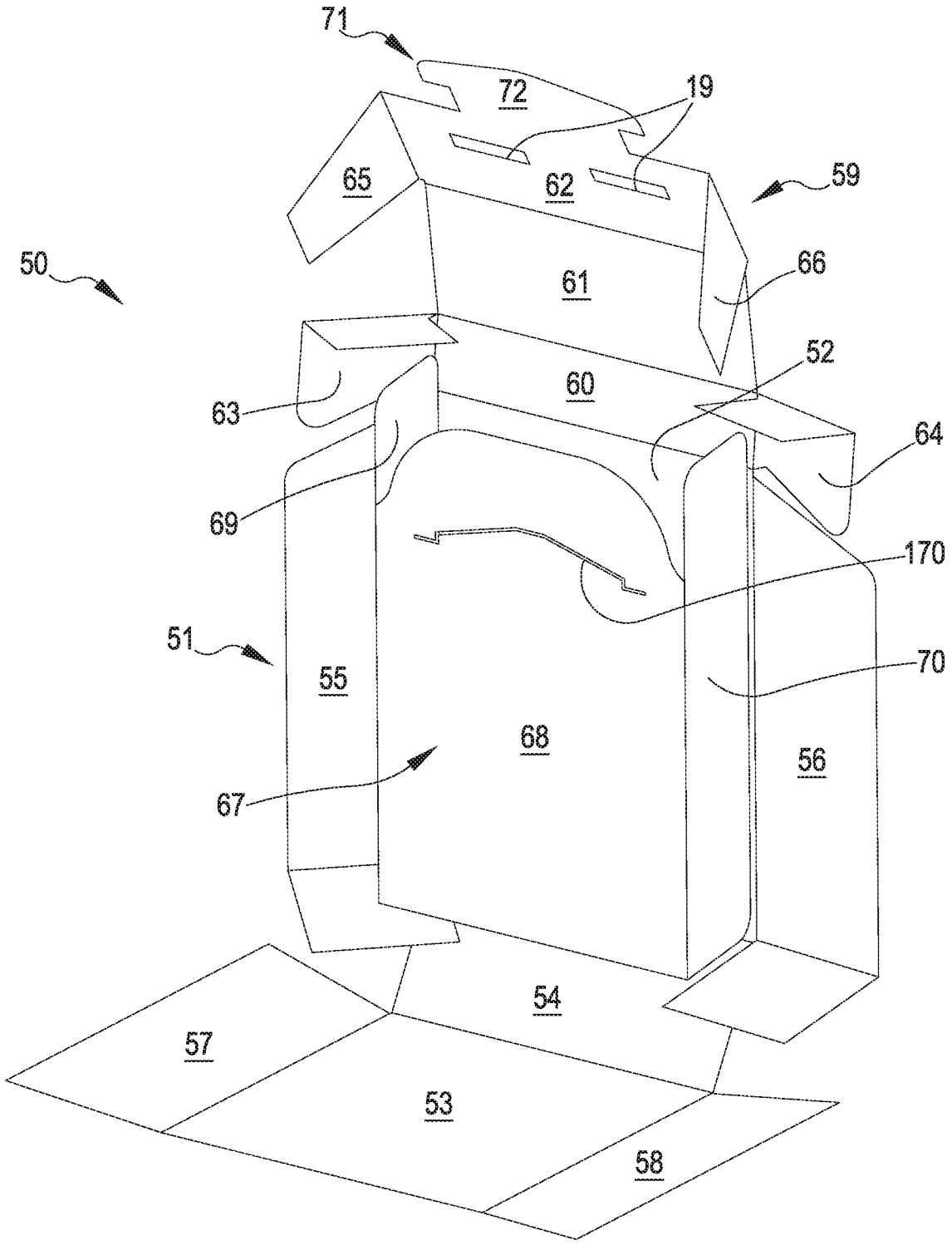

The procedure involves folding the side connection portions 69, 70 of the third sheet 67 with respect to the first portion 68 of the third sheet 67 and involves the arrangement the first portion 68 of the third sheet 67 in front of the first portion 52 of the first sheet 51. The phase prior the arrangement of the first portion 68 of the third sheet 67 frontally to the first portion 52 of the first sheet 51 is shown in FIG. 10, while the phase in which the first portion 68 of the third sheet 67 is arranged frontally to the first portion 52 of the first sheet 51 is shown in FIG. 11. Said phase involves the disposition of a notch 170 (see blank 50 of FIG. 1) or of a window (see blank 50 of FIG. 12) in front of the first portion 52 of the first sheet 51; the window defines, in an assembled condition of the container 1 obtainable through the procedure of realization of the container 1 here described, the passage seat 17. The phase of arrangement of the first portion 68 of the third sheet 67 frontally to the first portion 52 of the first sheet 51 also involves for the formation of the second coupling portion 13 and of the guide body 24. Said step can be carried out in such a way that the first lateral connecting portion 69 of the third sheet 67 and the second lateral connecting portion 70 of the third sheet 67 are arranged at an inner space of the first sheet 52 defined between the first and second lateral connecting portion 55, 56 of the first sheet 51 (condition shown in FIG. 11); surfaces of the first lateral connecting portion and the second lateral connecting portion 69, 70 of the third sheet 67 facing the inner space are essentially inner surfaces of the first lateral connecting portion and of the second lateral connecting portion 69, 70 of the third sheet 67. The procedure involves joining the first lateral connecting portion 69 of the third sheet 67 to the first lateral connecting portion 55 of the first sheet 52 by gluing an outer surface of the first lateral connecting portion 69 of the third sheet 67 to an inner surface of the first lateral connecting portion 55 of the first sheet 51. Similarly, the procedure may involve joining the second lateral connecting portion 70 of the third sheet 67 to the second lateral connecting portion 56 of the first sheet 51 by gluing an outer surface of the second lateral connecting portion 70 of the third sheet 67 to an inner surface of the second lateral connecting portion 56 of the first sheet 51. In this way, the third sheet 67 is engaged at the inner space of the first sheet 51 defined between the first and second lateral connecting portion 55, 56 of the first sheet 51.

The procedure may involve the arrangement of at least one product on an area of blank 50 intended to form an inner surface of a wall of storage room 2. For example, the product or a number of products may be placed on an area of sheet 51, for example, an area of the first portion 52 of sheet 51 intended to form an inner surface of the rear wall 4*b* of storage room 2 facing compartment 3 of store 2. Said phase is realized such that the product is interposed between the first portion 52 of the first sheet 51 and the first portion 68 of the third sheet 67. The arrangement of the product on blank 50 may be carried out earlier than the arrangement of the first portion 68 of the third sheet 67 compared to the first portion 52 of the first sheet 51.

The procedure involves the formation of the store 2. The store 2 is formed by folding and joining the lateral connecting portions 55, 56, 57, 58. The lateral connecting portions 55, 56, 57, 58 can be joined by gluing. The formation of the store 2 involves the arrangement, by folding the blank 50, first and second portion 52, 53 of the first sheet 51 in front of each other so that the central connecting portion 54 forms a bottom wall 4*e* of the store 2. During the phase of arrangement of the first and second portion 52, 53 of the first sheet 51 facing each other, the third lateral connecting portion 57 of the first sheet 51 and the first lateral connecting portion 55 of the first sheet 51 are brought closer and the fourth lateral connecting portion 58 of the first sheet 51 and the second lateral connecting portion 56 of the first sheet 51 are brought closer each other; said condition can be achieved by bringing the second portion 53 of the first sheet 51 closer to the first portion 68 of the third sheet 67 starting from the condition of the blank 50 shown in FIG. 11. The third lateral connecting portion 57 of the first sheet 51 and the first lateral connecting portion 55 of the first sheet 51 are then joined together and the fourth lateral connecting portion 58 of the first sheet 51 and the second lateral connecting portion 56 of the first sheet 51 are joined together, for example by gluing. The joining phase between the third lateral connecting portion 57 of the first sheet 51 and the first lateral connecting portion 55 of the first sheet 51 can be carried out by gluing an outer surface of the first lateral connecting portion 55 of the first sheet 51 to an inner surface of the third lateral connecting portion 57 of the first sheet 51. Similarly, the joining phase between the fourth lateral connecting portion 58 of the first sheet 51 and the second lateral connecting portion 56 of the first sheet 51 can be performed by gluing an outer surface of the second lateral connecting portion 56 of the first sheet 51 to an inner surface of the fourth lateral connecting portion 58 of the first sheet 51.

The procedure also comprises the formation of the closure system 7. Said phase involves folding the first, second and third portions 60, 61, 62 of the second sheet 59 so as to respectively form the rear panel 7*e*, the top panel 7*a* and the front panel 7*b* of the closure system 7. The formation phase of the closure system 7 also involves the formation of the first and the first and second side panels 7*c*, 7*d* of the closure system 7 as described below. The formation of the side panels 7*c*, 7*d* of the closure system 7 involves folding the sixth portion 65 and the seventh portion 66 of the second sheet 59 with respect to the third portion 62 and approaching it in such a way as to define an internal space between them; surfaces of the sixth and seventh portion 65, 66 facing the internal space are essentially internal surfaces of the sixth and seventh portion 65, 66. The formation phase of the closure system 7 also involves folding the fourth and fifth portions 63, 64 of the second sheet 59 with respect to the first portion 60 of the second sheet 59 and approaching with respect to it; at this point, the fourth and fifth portions 63, 64 of the second sheet 59 are placed in correspondence with the internal space defined between the sixth and seventh portions 65, 66 of the second sheet 59. The formation phase of the closure system 7 also involves joining the sixth portion 65 to the fourth portion 63 of the second sheet 59, for example by gluing an inner surface of the sixth portion 65 to an outer surface of the fourth portion 63, and involves joining the seventh portion 66 to the fifth portion 64 of the second sheet 59, for example by gluing an inner surface of the seventh portion 66 to an outer surface of the fifth portion 64. The sixth and fourth portions 65, 63 of the second sheet 59 thus joined form the first side panel 7*c* of the closure system 7 and the seventh and fifth portions 66, 64 of the second sheet 59 thus joined form the second side panel 7*d* of the closure system 7.

The procedure also comprises the arrangement of the fourth sheet 71 to form the first coupling portion 12 of the safety device 11. The first coupling portion 12 is defined by the first portion 72 of the fourth sheet 71.

The procedure may also include the phase of forming the pushing device 25. With reference to the blank of FIG. 12, the formation of the pushing device 25 involves folding the fifth sheet 73 with respect to the extremal edge 53*a* of the second portion 53 of the first sheet 51 so that it results facing the second portion 53 of the first sheet 51. With reference to the formation of the store 2 described above, when the second portion 53 of the first sheet 51 is placed frontally with respect to the first portion 68 of the third sheet 67, the procedure involves moving the fifth sheet 73, already folded, integrally with the second portion 53 of the first sheet 51 and inserting the first portion 74 of the fifth sheet 73 into the slot 170 or into the window 17 of the third sheet 67 in such a way as to form the pushing device 25 in rest condition in the compartment 3 of the store 2.

The process of making a container 1 from the blank of FIG. 17 is now described.

The procedure involves forming the store 2 by joining the lateral connecting portion 69 of the third sheet 67 to the central connecting portion 54 of the first sheet 51, optionally by gluing. This phase is carried out by moving the third sheet 67 in such a way that, following the joining of the lateral connecting portion 69 of the third sheet 67 to the central connecting portion 54 of the first sheet 51, the first portion 68 of the third sheet 67 is placed frontally with respect to the first portion 52 of the first sheet 51 to form the panel 10 and then the second coupling portion 13 and the guide body 24. In this way, window 17 of the first portion 68 of the third sheet 67 results facing the first portion 52 of the first sheet 51. The formation of the store 2 also involves folding the foldable portion 51*a* of the first sheet 51 with respect to the second portion 53 of the first sheet 51; in particular, the foldable portion 51*a* of the first sheet 51 is flattened to the second portion 53 of the first sheet 51. The foldable portion 51*a* of the first sheet 51 is then joined to the second portion 53 of the first sheet 51, for example by gluing together the mutually facing inner surfaces of the second portion 53 of the first sheet 51 and the foldable portion 51*a*. The procedure then involves folding the fifth sheet 74 with respect to the extremal edge 51*a*' of the tilting portion 51*a* as it approaches an outer surface of the tilting portion 51*a* to form the pushing device 25. Following the joining of the lateral connecting portion 69 of the third sheet 67 to the central connecting portion 54 of the first sheet 51, the tilting portion 51*a* and the second coupling portion 13, which are now joined together as they were previously joined, are moved in such a way that the outer surface of the tilting portion 51*a* is located at an outer surface of the first portion 68 of the third sheet 67. The outer surface of the first portion 68 of the third sheet 67 may be defined as the surface opposite an inner surface of the first portion 68 of the third sheet 67, which is facing and directly facing the first portion 52 of the first sheet 51 forming the rear wall 4*b* of the store 2. The step that involves placing the tilting portion 51*a* on the outer surface of the first portion 68 of the third sheet 67 involves to insert the pushing device 25 in the window 17 of the third sheet 67 in such a way as to position the pushing device 25 in compartment 3 of the store 2. Optionally, the tilting portion 51*a* may be glued to the outer surface of the first portion 68 of the third sheet 67 to form the front wall 4*a* of the store 2. The step involving placing the tilting portion 51*a* on the outer surface of the first portion 68 of the third sheet 67 also involves placing the fourth portion 51*c* of the first sheet 51 in front of the third portion 51*b* of the first sheet 51, or vice versa. These portions may be folded with respect to the respective folding edges defined at the respective extremal edges 53*a*, 52*a* of the second portion 53 and the first portion 52 in such a way as to arrange the third portion 51*b* of the first sheet at the fourth portion 51*c* of the same first sheet 51. The third and fourth portions 51*b*, 51*c* of the first sheet 51 can then be joined together, for example by gluing, to form the bottom wall 4*e* of storage room 2. The procedure may also involve forming the tamper evident portion 26. The formation of the tamper evident portion 26 involves folding the third portion 78 of the sixth sheet 75 with respect to the first and second portions 76, 77 of the sixth sheet 75 and also involves moving the sixth sheet 75 towards the second sheet 59. The sixth sheet 75 can be moved together with the second portion 53 of the first sheet 51 in such a way as to bring, for example in the phase involving the arrangement the tilting portion 51*a* joined to the second portion 53 of the first sheet 51 to the first portion 68 of the third sheet 67, the tilting portion 51*a* joined to the second portion of the first sheet to the first portion 52 of the first sheet 51 and simultaneously bring the sixth sheet 75 to the second sheet 59. The third portion 78 of the sixth sheet 75 can be joined, for example by gluing, to the second portion 61 of the second sheet 59 and optionally to the seventh portion 66 of the second sheet 59. The joining of third portion 78 of sixth sheet 75 to the second portion 61 of second sheet 59 may be made by gluing an outer surface of the third portion 78 of sixth sheet 75 to an inner surface of the second portion 61 of second sheet 59 intended to face, in the assembled condition of the container 1, the compartment 8 of the closure system 7.

Eventually, the process of making the container 1 may include a stage of providing the seventh sheet to form an opening device 20.

The manufacturing process therefore makes it possible to create a childproof the container 1 of the type described above. At the end of the procedure, a the container 1 is obtained whose closure system 7 is in the opening condition and, where provided, in which the pushing device 25 is in the resting condition and, in addition or alternatively, in which the tamper evident portion 26 is in the intact condition, in which it prevents access to through access 19. The closure system 7 of the container 1 may then be brought into the closing condition; in this condition, the container 1 may be opened, by an adult, by means of the opening device 20 according to the opening method previously described.

The invention claimed is:

1. A childproof container comprising:

a store made of sheet material comprising a front wall, a rear wall opposite to the front wall, a first side wall and a second side wall opposite to the first side wall, wherein said front wall, rear wall, first side wall and second side wall define a passage opening delimited by a free edge, a closure system made of sheet material engaged to the rear wall of the store at the free edge and movable with respect to the free edge of the store between:

a closing condition in which the closure system interdicts communication between the opening passage of the store and an environment to the container, an opening condition in which the closure system allows communication between the opening passage of the store and the environment external to the container, the closure system comprising a top panel from which a front panel, a first side panel and a second side panel emerge, the top panel, the front panel, the first side panel and the second side panel defining a compartment delimited by a respective free edge, wherein the closure system and the store, in the closing condition, cooperate to define an internal volume of the container, a safety device made of sheet material having:

at least a first coupling portion carried by the front panel of the closure system, at least a second coupling portion arranged, in the closing condition of the closure system, in the internal volume of the container, said second coupling portion at least partly directly facing the front wall, of the store, wherein the second coupling portion is configured to cooperate with said first coupling portion, wherein the first and second coupling portion are configured to engage each other in the internal volume of the container in the closing condition of the closure system to define a locking condition in which said first and second coupling portion prevent the closure system from switching from the closing to the opening condition, wherein the front panel of the closure system comprises an unlocking portion configured to define a through access configured to allow, at least in the locking condition of the safety device, the insertion of an opening device into the internal volume of the container allowing the disengagement between the first and second coupling portions, wherein the container further includes a guide body carried by at least one of the second coupling portion and the closure system, said guide body, in the closing condition of the closure system, being placed in the internal volume of the container and facing the unlocking portion, wherein the guide body emerges beyond the free edge of the store and configured to guide the opening device towards the safety device.

2. The container of claim 1, wherein the guide body, in the closing condition of the closure system, extends into the compartment of the closure system.

3. The container of claim 1, wherein, the guide body, the first coupling portion and the second coupling portion, in the closing condition of the closure system, are entirely housed in the internal volume of the container.

4. The container of claim 1, wherein guide body is directly carried by the second coupling portion, the guide body being in a single piece with the second coupling portion.

5. The container of claim 1, wherein the guide body extends from the second coupling portion along a direction exiting the store.

6. The container of claim 1, wherein the store comprises a bottom wall connected to the front wall, the rear wall, the first side wall and the second side wall of the store on the opposite side with respect to the passage opening of the store itself, wherein the guide body is arranged at a height greater than a height of the free edge of the store, these heights of the guide body and of the free edge of the store being respectively defined as the distance of the guide body and the free edge from the bottom wall respectively.

7. The container of claim 1, wherein the through access is delimited perimetrically by a closed path profile, wherein the through access develops completely on the front panel of the closure system, wherein the through access is spaced from the free edge of the closure system and from the top panel.

8. The container of claim 1, wherein the second coupling portion is arranged inside the store at the free edge of sad store.

9. The container of claim 1 comprising a pushing device arranged at least partially inside the store at the second coupling portion, the pushing device being configured to push on at least one of the first coupling portion and the second coupling portions to ensure the engagement of the latter and thus keep the safety device in the locking condition.

10. The container of claim 9, wherein the pushing device is configured to contact the first coupling portion during the passage of the closure system from the opening to the closing condition and push said first coupling portion against said second coupling portion, wherein the pushing device acting in push only on the first coupling portion.

11. The container of claim 9, wherein the pushing device is elastically movable between:

a thrust condition in which the pushing device itself operates in thrust on the safety device in the closing condition of the closure system to keep the first coupling portion and the second coupling portion engaged, and a rest condition.

12. The container of claim 11, wherein the pushing device defines the rest condition in the opening condition of the closure system, wherein the movement of the pushing device between the rest condition and the thrust condition is triggered by the first coupling portion during the passage of the closure system from the opening condition to the closing condition and defines a snap engagement between the first coupling portion and the second coupling portion.

13. The container of claim 9, wherein the second coupling portion comprises a hook delimiting an undercut and defining a passage seat, said hook of the second coupling portion having a concavity facing, in the closing condition, the opposite side with respect to the closure system, the pushing device being placed at least partially inside the passage seat of the hook of the second coupling portion.

14. The container of claim 13, wherein the first coupling portion comprises a hook delimiting an undercut and defining a respective seat, the hook of the first coupling portion, in the locking condition, being engaged to the hook of the second coupling portion, wherein the pushing device is configured to push the first coupling portion, in the closing condition of the closure system, to keep the hook of the first coupling portion engaged to the hook of the second coupling portion.

15. A childproof container comprising:

a store made of sheet material comprising a front wall, a rear wall opposite to the front wall, a first side wall and a second side wall opposite to the first side wall, wherein said front wall, rear wall, first side wall and second side wall define a passage opening delimited by a free edge, a closure system made of sheet material engaged to the rear wall of the store at the free edge and movable between:

a closing condition in which the closure system interdicts communication between the opening passage of the store and an environment to the container, an opening condition in which the closure system allows communication between the opening passage of the store and the environment external to the container, the closure system comprising a top panel from which a front panel, a first side panel and a second side panel emerge, the top panel, the front panel, the first side panel and the second side panel defining a compartment delimited by a respective free edge, wherein the closure system and the store, in the closing condition, cooperate to define an internal volume of the container, a safety device made of sheet material having:

at least a first coupling portion carried by the front panel of the closure system, at least a second coupling portion arranged, in the closing condition of the closure system, inside the store at the free edge of said store, said second coupling portion at least partly directly facing the front wall of the store, wherein the second coupling portion is configured to cooperate with said first coupling portion, wherein the first and second coupling portion are configured to engage each other in the internal volume of the container, in the closing condition of the closure system, to define a locking condition in which said first and second coupling portion prevent the closure system from switching from the closing to the opening condition, wherein the front panel of the closure system comprises an unlocking portion configured to define a through access configured to allow, at least in the locking condition of the safety device, the insertion of an opening device into the internal volume of the container allowing the disengagement between the first and second coupling portions.

16. A childproof container comprising:

a store made of sheet material comprising a front wall, a rear wall opposite to the front wall, a first side wall and a second side wall opposite to the first side wall, wherein said front wall, rear wall, first side wall and second side wall define a passage opening delimited by a free edge, a closure system made of sheet material engaged to the rear wall of the store at the free edge and movable between:

a closing condition in which the closure system interdicts communication between the opening passage of the store and an environment to the container, an opening condition in which the closure system allows communication between the opening passage of the store and the environment external to the container, the closure system comprising a top panel from which a front panel, a first side panel and a second side panel emerge, the top panel, the front panel, the first side panel and the second side panel defining a compartment delimited by a respective free edge, wherein the closure system and the store, in the closing condition, cooperate to define an internal volume of the container, a safety device made of sheet material having:

at least a first coupling portion carried by the front panel of the closure system, at least a second coupling portion arranged, in the closing condition of the closure system, in the internal volume of the container, said second coupling portion at least partly directly facing the front wall of the store, wherein the second coupling portion is configured to cooperate with said first coupling portion, wherein the first and second coupling portion are configured to engage each other in the internal volume of the container, in the closing condition of the closure system, to define a locking condition in which said first and second coupling portion prevent the closure system from switching from the closing to the opening condition, wherein the front panel of the closure system comprises an unlocking portion configured to define a through access configured to allow, at least in the locking condition of the safety device, the insertion of an opening device into the internal volume of the container allowing the disengagement between the first and second coupling portions, wherein the container includes a pushing device arranged at least partially inside the store at the second coupling portion, the pushing device being configured to push on at least one of the first coupling portion and the second coupling portion to ensure the engagement of the latter and thus keep the safety device in the locking condition.

17. The container of claim 16, wherein the pushing device, during the passage of the closure system from the opening condition to the closing condition, pushes said first coupling portion against said second coupling portion.

18. The container of claim 16, wherein the pushing device is elastically movable between:

a thrust condition in which the pushing device thrusts on the safety device to keep the first coupling portion and the second coupling portion engaged, and a rest condition.

* * * * *